US012605610B1

(12) United States Patent
Pearson, III

(10) Patent No.: US 12,605,610 B1
(45) Date of Patent: Apr. 21, 2026

(54) ABOVE-GROUND, AND/OR SUBTERRANEAN GOLF DRIVING RANGE WITH RANGE-FIELD-SURFACE(S) INTENTIONALLY SLOPED, OR SLANTED LONGITUDINALLY

(71) Applicant: John J. Pearson, III, Tucson, AZ (US)

(72) Inventor: John J. Pearson, III, Tucson, AZ (US)

( * ) Notice: Subject to any disclaimer, the term of this patent is extended or adjusted under 35 U.S.C. 154(b) by 0 days.

(21) Appl. No.: 18/375,784

(22) Filed: Oct. 2, 2023

Related U.S. Application Data

(60) Provisional application No. 63/378,562, filed on Oct. 6, 2022.

(51) Int. Cl.
*A63B 69/36* (2006.01)
*A63B 47/02* (2006.01)

(52) U.S. Cl.
CPC ..... *A63B 69/3694* (2013.01); *A63B 47/025* (2013.01)

(58) Field of Classification Search
CPC ..... A63B 69/3694; A63B 47/025
See application file for complete search history.

(56) References Cited

U.S. PATENT DOCUMENTS 3,184,239 A 5/1965 Heuser
3,310,310 A * 3/1967 McKee ..... A63B 69/3697 473/153
3,314,679 A 4/1967 Kolln
3,706,452 A 12/1972 Soucie
3,863,922 A 2/1975 Peeples
3,897,947 A 8/1975 Heffley, Jr.
4,767,121 A 8/1988 Tonner
4,902,541 A * 2/1990 Martino ..... E01C 13/08 428/17
5,513,841 A 5/1996 Takagi
6,569,028 B1 * 5/2003 Nichols ..... A63B 69/3694 473/153
6,921,342 B2 7/2005 Jong
7,479,073 B2 1/2009 Pelley et al.
7,513,841 B2 4/2009 Clifford
8,257,189 B2 9/2012 Koudele et al.
8,409,024 B2 4/2013 Marty et al.
9,339,715 B2 5/2016 Luciano, Jr
9,427,639 B2 8/2016 Rauchholz et al.
10,605,910 B2 3/2020 du Toit et al.
10,801,224 B1 * 10/2020 Sorrentino ..... A63B 69/3691
(Continued)

FOREIGN PATENT DOCUMENTS

JP H0647477 Y2 * 12/1994
KR 102213285 B1 * 2/2021 ..... A63B 71/04
WO WO-0137948 A1 * 5/2001 ..... A63B 69/36

*Primary Examiner* — Jeffrey S Vanderveen

(57) ABSTRACT

It is an objective of the present invention to provide systems, devices, and/or methods allowing for the faster, easier determination of the carry distance for golf balls hit with golf clubs, the automatic return of range golf balls for reuse, containment nets that don't touch or get close to supports or poles, range field surfaces that don't use artificial or natural grass or need water, and instead use soft, rubbery, polymer, or other synthetic (recyclable) materials for range field surfaces to permanently eliminate the need to use water, chemicals, workers, ball-pick-up-equipment, carts/tractors (fuel), machinery, or do any maintenance on range field surfaces at golf driving ranges.

8 Claims, 34 Drawing Sheets

Subterranean "Tub" Golf Range Design

Section 1: Side View

Section 2: View of Hitting Platforms/Lobby From Back Wall

(56) References Cited

U.S. PATENT DOCUMENTS

| | | | | |
|---|---|---|---|---|
| 10,960,284 | B2 | 3/2021 | Yun | |
| 2003/0125121 | A1 * | 7/2003 | Rhee | A63B 63/00 473/197 |
| 2005/0227792 | A1 | 10/2005 | McCreary et al. | |
| 2006/0287120 | A1 | 12/2006 | Weaver et al. | |
| 2015/0290519 | A1 | 10/2015 | Lindsay | |

* cited by examiner

HittingPlatformArea

Subterranean "Tub" Golf Range Design

Stairwell (1st, 2nd, & 3rd Levels of Hitting Platform)

2001 Down to 2nd Level
2002 Up to 3rd Level
2003 Down to 2nd Level
2004 Down to 1st Level
2005 Up to 3rd Level
2006 Up from 1st Level
2007 Down to 1st Level
2008 Up to 2nd Level
2009 Landing Automatic Containment Net Lifter & Lowering System
Front View Automatic Containment Net Lifter & Lowering System Automatic Containment Net Lifter & Lowering System Automatic Containment Net Lifter & Lowering System

ABOVE-GROUND, AND/OR SUBTERRANEAN GOLF DRIVING RANGE WITH RANGE-FIELD-SURFACE(S) INTENTIONALLY SLOPED, OR SLANTED LONGITUDINALLY

RELATED APPLICATIONS

This application claims the benefit of U.S. provisional application No. 63/378,562 filed on Oct. 6, 2022. The referenced provisional application is incorporated by reference herein.

FIELD OF THE INVENTION

The present invention relates to golf driving ranges designed for practicing and learning to golf. More particularly, the present invention relates to above-ground (above the average adjacent grade) and subterranean (below the average adjacent grade, partially or fully) golf ranges with range field surfaces intentionally sloped, or slanted longitudinally so that range golf balls automatically return for reuse to a ball-bin, or depository, and to allow for faster, easier determination of "carry" distance (how far a golf ball flies in the air) for golf balls hit with a golf club from a tee-area/hitting platform at a driving range.

The present invention intentionally slopes golf driving range field surfaces longitudinally using several designs for above-ground, and/or subterranean golf driving ranges using rubbery, soft, materials such as any type of rubber, including foam rubber, latex, isoprene, caoutchouc, polyethylene or a blend, or combination of these and/or other flexible, stretchy, resilient, recyclable materials (such as worn-out, old automobile tires melted-down into different forms of rubber) for range field surfaces while never using natural grass which has been used for about 500 years, or synthetic/artificial turf which current range design has been using for driving range field surfaces more recently. The invention uses colored horizontal, distance demarcations (yardage lines) systematically spaced apart to allow for faster, easier determination of carry distance for golf balls hit with golf clubs after they land on a range field surface. The invention uses a containment net system allowing containment nets that never touch or get tied to poles. The invention uses a multi-level hitting platform system to allow multiple level hitting platforms to be positioned on top of each other, but they're set back a correct distance to make yardages marked on the range field surface accurate no matter what level of a hitting platform golfers hit golf balls from! The invention eliminates the need to use water, chemicals, workers, mowers, carts/tractors, ball-pick-up-equipment, machinery and more on driving range field surfaces. The present invention is the first to do these useful, innovative design changes that provide great benefit to many by saving money, time, water, hassles, and more while permanently eliminating daily costs, problems, and headaches that other current design golf ranges can't avoid! The invention is non-obvious as current design golf ranges have used mostly the same design for too long, and it'll soon be obvious how useful the present invention is!

BACKGROUND OF THE INVENTION

"The harder I work and practice, the luckier I get."—Gary Player. Golf enthusiasts habitually practice their sport for enjoyment and the improvement of their swing. Driven by the idea, "practice does not make perfect, only perfect practice makes perfect", many golfers desire to spend their time in pursuit of this perfection. However, while a large variety of potential locations could possibly be used for practice, suitable golf driving ranges are limited. Additionally, the conditions of many existing golf driving ranges are bad, problematic, and even dangerous.

The ideal golf driving range has a dry, level, hitting surface/tee area for golf balls to be hit from and a soft landing surface (range field surface) for golf balls to land or "hit" on. If a range field surface isn't sufficiently soft, the range golf balls can be damaged on impact, diminishing their suitability for reuse. Traditionally, well-manicured grass has been kept as the most desirable golf driving range field surface. However, there are certain drawbacks to natural grass golf driving ranges, which are especially relevant in areas with hot, dry climates, water restrictions and/or drought conditions.

Natural grass requires a certain amount of direct sunlight. This requirement limits the amount of shade that may be provided to those wanting to practice at golf driving ranges often leaving golfers to practice directly in the hot sun. This sun exposure is known to increase a golfers risk of developing skin cancer, heat stroke, sunburn, dehydration, and other health issues. The very solar energy necessary for the cultivation of a suitable natural grass surface may be detrimental to the well-being of the people for which the turf is grown and maintained for.

Furthermore, natural grass surfaces require large amounts of water and care. While certain types of vegetation may survive dry or drought conditions, the types of lush grasses best suited for golf driving range surfaces will die if they don't receive sufficient hydration. As water has become a more precious and limited resource in many parts of the U.S., and world, communities are working hard to find ways to reduce water usage. Because many driving ranges use a substantial volume of water for what's considered a non-essential purpose, they're increasingly targeted for their water consumption by conservationists, environmentalists, government agencies, politicians, and local communities/residents.

While a few golf driving ranges have converted to using artificial or synthetic turf in place of natural grass, the overall design of these converted golf driving ranges has remained mostly similar to designs which were optimized for natural grass. The time has come for radically different golf driving range designs which highlight and use the superior properties of new, different, unconventional range field surfaces to provide a drastically improved experience for golfers, range-owners and communities.

BRIEF SUMMARY OF THE INVENTION

It is an objective of the present invention to provide systems, devices, and/or methods allowing for the faster, easier determination of the carry distance for golf balls hit with golf clubs, the automatic return of range golf balls for reuse, containment nets that don't touch or get close to supports or poles, range field surfaces that don't use artificial or natural grass or need water, and instead use soft, rubbery, polymer, or other synthetic (recyclable) materials for range field surfaces to permanently eliminate the need to use water, chemicals, workers, ball-pick-up-equipment, carts/tractors (fuel), machinery, or do any maintenance on range field surfaces at golf driving ranges as specified in the independent claims.

In some embodiment's, the present invention's driving range designs feature range field surfaces intentionally sloped longitudinally with pitch, or slope angles, and firm, but soft, smooth, friction-less range field surfaces such that golf balls are unable to remain stationary, and roll down to a canal, ball drain inlet, or other depository which may function as a part of a ball-return system that's designed to lift balls back to the one or more levels of a hitting platform or other ball-dispensing location so as to facilitate convenient reuse. The intentionally sloped range field surfaces may be marked with verified distance demarcations that allow for faster, and easier determination of the carry distance for golf balls.

One of the unique and inventive technical features of the present invention is the use of above-ground, and/or subterranean (either partially or fully) golf driving ranges such that the hitting platform, and/or range field surface are constructed, or excavated at an elevation above and/or below the average adjacent grade. This technical feature allows for many benefits including, but not limited to the better protection of golfers, golf balls, containment nets, and range field surfaces from sun, wind, rain, cold, and other unwanted environmental exposures. Without wishing to limit the invention to any theory or mechanism, it's believed a technical feature of the present invention is it advantageously allows for the faster, and easier determination of the carry distance for golf balls hit with golf clubs, and the automatic return of golf balls for reuse on above-ground, and/or subterranean range field surfaces. The present invention permanently eliminates the need to use water, chemicals, ball-pick-up equipment, machinery, carts, tractors, fuel or maintenance workers as specified in the independent claims, and uses polymers, 3 rubber, or other soft, recyclable non-grass or turf materials for range field surfaces that protect golf balls better from impact damage, and also allows range field surfaces to become water-harvesting surfaces when it rains as the water goes into a drainage system that sends it to an underground (aquifer) storage. None of the presently known prior references or work has the unique, innovative, inventive technical features that the present invention has!

Furthermore, prior references teach away from the present invention. For example, the following descriptions illustrate the present invention is different from current teaching in the industry.

Current range design uses intentionally flat (0 feet above/below the average adjacent grade), or natural (no grading/limited grading) range field surfaces. The present invention uses intentionally sloped/slanted above-ground (above the average adjacent grade) or subterranean (below the average adjacent grade, either fully or partially) range field surfaces with NO flat areas on them whatsoever!

Current range design uses only natural grass, synthetic/artificial grass or "dirt" as range-field-surfaces. The present invention uses only rubbery, polymeric, and/or other soft, smooth, firm but not hard, friction-less non-grass (no natural, artificial or synthetic grass!) materials for range field surfaces.

Current range designs use above-ground yardage-signs, and/or targets, and allow trees, poles, rocks and other above-ground objects on range field surfaces that damage or ruin range golf balls. The present invention uses colored horizontal distance demarcations (yardage lines) and yardage numbers of different sizes that are painted or printed directly on the range field surface itself with nothing hard above-ground on the range field surface whatsoever that might damage, harm or ruin range golf balls.

Current range design yardage-signs at golf ranges using natural grass tee-areas are correct, or true about 4 times each year when the line yardages were measured from on a grass tee-area is back on the same exact line. It takes about 3 months, and lots of grass seed, fertilizer, water, and sun for natural grass to regrow/heal from the massive damage golfers can do making divots on natural grass tee-areas which means their yardage-signs are correct (true) about 4 times a year (3 months into 12=4 times) or 1% of time, and the yardage-signs are wrong about 99% of the time (year)! The present invention uses a "True Tier Hitting Platform" system with a yardage-measurement-line marked on a cement pad under all hitting-mats that never moves, and is laser-measured to be 100% accurate (true) all the time (year)! The present invention also uses a multi-level hitting platform set back system, so all colored horizontal distance demarcations, and distance (yardage) numbers marked (printed/painted) directly on range field surfaces are accurate all the time no matter which level of a hitting platform is used to hit balls, and to allow the faster, easier determination of carry distance for golf balls hit with golf clubs after a ball lands on the range-field-surface near a distance demarcation marked with a corresponding distance number.

Current range design uses containment nets that touch and get tied tightly to each pole top-to-bottom, or use ball-damaging (chain-link) fences or don't use any type of fence at all (losing golf balls). The present invention uses containment net systems that intentionally don't touch, get tied or get close to poles. Containment nets hang "free" from angled-supports above the range field surface until they're secured directly to the range field surface below allowing golf balls hitting the containment net to fall gently to the range field surface without hitting anything hard and helping range golf balls last longer!

Current range design uses containment nets that get tied tightly to poles from top-to-bottom that weaken as year-round weather (super hot/freezing cold) deteriorates them. Weak containment nets held tightly to poles can split-open after enough golf balls hit them at 100+ mph, exposing homes, cars, businesses, people, and more to being hit by errant golf balls that go through the openings. Repairs can take a few weeks, or many months creating other problems (lost golf balls, liability/lawsuits, etc.). The present invention uses a "Rapid Release & Reattach" containment net system that doesn't tie, touch or get close to any poles helping containment nets to last longer, and not split-open as soon. If repairs or replacement are needed, containment nets release and reattach rapidly, or automatically, so they can be repaired/replaced sooner, and back "up" in position much faster to eliminate many potential problems!

Current range design uses see-through nylon containment nets attached to poles going around a range field surface that are easy to vandalize (cut) which can allow golf balls to escape a golf driving range, and injure people, or property. This also allows uninvited guests (people, animals, debris) access to range field surfaces creating more problems for golf range owners, and golfers wanting to practice! The present invention uses a 12-90 foot (height) perimeter wall that goes around the entire exterior of the golf range to keep golf balls "in", uninvited guests "out", and golf ranges look better without poles and/or containment nets being seen at street-level. Golf driving ranges are also safer, and last longer!

Embodiment's of the present invention's designs are contrarily above-ground, and subterranean (partially or fully) golf ranges with intentionally sloped, or slanted (longitudinally) range field surfaces.

Current design range field surfaces are flat (0 feet above/below the average adjacent grade), or left natural with no intent to slant, or slope them down below the average adjacent grade via excavation (subterranean), or above the average adjacent grade via construction (above-ground), or to allow range field surfaces to automatically return balls to a desired location for reuse leaving a range field surface clear of balls (self-cleaning), or to allow the faster, easier determination of carry distance for golf balls hit with golf clubs from a hitting (tee) area due to range field surfaces that slant and tilt toward golfers.

The present invention excavates (below-ground) or builds (above-ground) range field surfaces intentionally sloped longitudinally for the automatic return of golf balls back to a desired location for reuse, and faster, easier determination of carry distance for balls hit with golf clubs. Observation areas, ball-dispensing locations, tee-areas, and range field surfaces are intentionally excavated below-ground or built-up above-ground. Future range field surfaces could be to depths or heights of 100 feet or more!

Current range design exposes golfers and everything (golf balls, mats, nets, etc.) to year-round weather conditions that can be undesirable or unbearable at times. It's contrary to what golfers, owners, environmentalists, politicians, and local communities want, and contrary to what's best for all of them as well (a better warm-up/practice, better business, no water or chemical use, better, safer golf ranges).

Golfers go to golf ranges to warm-up before playing a golf course, to practice their swings, for golf lessons, or to get some exercise just hitting a bucket-of-balls, but what stops a golfer from going? 1. The weather outside is bad, and golfers don't want to be "exposed" for 30-60 minutes or more! 2. The golf range is closed (rain, no range balls, split-open containment nets, limited hours, etc.). 3. A golf range has bad conditions (bad balls, bad grass/mats, bad range fields) so it's not worth going! 4. A golf range doesn't have enough hitting stalls (places) for all the golfers wanting to hit golf balls. 5. The golf range charges too much, or hourly to hit golf balls, so it's too expensive for many people. 6. A golf range has a natural grass tee-area with no roof to protect them from the sun, rain, hail or more.

Bad weather conditions (super-hot, freezing-cold, rain, wind) are big reasons golfers don't go to golf ranges! It's a reason many ranges "close" when it rains as it's costly to open due to balls get muddy or burying in muddy ground requiring extra effort to get and/or clean them for reuse. Golf balls get lost plugging below-ground, and new golf balls are costly. Ball-pick-up equipment, cart, tractor, and mower tires can damage wet range field surfaces via tearing-them-up. If balls don't get picked-up until a range field surface is dry, muddy balls are harder to get out of the ground, and to get clean again for reuse!

Range Field Surfaces Intentionally Sloped/Slanted Longitudinally

The present invention has range field surface designs intentionally sloped longitudinally for above-ground, and subterranean golf driving ranges that can be customized to fit different situations, (property) locations, and desires, but 4 of the present invention's main golf driving range designs are:

The Slide subterranean range field surface is intentionally sloped/slanted longitudinally from the back-edge of a range-field-surface 0 feet above/below the average adjacent grade, that's excavated and graded downhill 450-900 feet/150-300 yards in distance at a slope degree angle that's less than 1%, or more than 12%, to drop about 5-100 feet in elevation below the average adjacent grade until the range field surface goes underneath the bottom/first-level hitting-platform that's 4-70 feet in elevation below an average adjacent grade to form an uphill range field surface (hitting platform view) that sends range golf balls hit from the hitting platform back down the range field surfaces via gravity until the balls go underneath the bottom/first-level hitting platform, and roll into a ball-bin, or other depository so a ball return system can take the range golf balls back to the ball-dispensing location(s).

The Slide above-ground range field-surface is intentionally sloped/slanted longitudinally from the back edge of a range field surface built 5-100 feet in elevation above the average adjacent grade. A range field surface 450-900 feet/150-300 yards in distance is built with a slope degree angle that's less than 1%, or more than 12%, to drop about 5-100 feet in elevation from above an average adjacent grade until the range field surface goes underneath the bottom/first-level hitting platform that's 1-30 feet in elevation above the average adjacent grade to form an uphill range field surface (hitting platform view) that sends range golf balls hit from the hitting platform back down the range field surface via gravity until the balls go underneath the bottom/first-level hitting platform, and roll into a ball-bin, or other depository so a ball return system can take the range golf balls back to the ball-dispensing location(s).

The Tub subterranean range field surface is intentionally sloped/slanted longitudinally to form 2 slides of different length, and slope that face toward each other so range golf balls roll into a ball drain inlet positioned on the range field surface between both slides. The "top" of Slide #1 is the back edge of a range field surface that's 0 feet in elevation above/below the average adjacent grade, and 450-900 feet/150-300 yards in distance away from a bottom/first-level hitting platform. The range field surface is excavated, and graded downhill at a slope degree angle of less than 1%, or more than 24%, for 165-855 feet/55-285 yards in distance to drop 5-75 feet (height) to a ball drain inlet 10-105 feet in elevation below an average adjacent grade located on a range field surface between the 15 yard-line and 95 yard line to form an uphill range field surface (hitting platform view) that sends golf balls hit from a hitting platform back down the range field surface via gravity until the balls roll in the ball drain inlet, and go into a ball-bin, or depository so a ball-return system can take the golf balls back to the ball-dispensing location(s). The "bottom" of Slide #1 is the ball drain inlet on the range field surface located between the 15 yard line and 95 yard line that's 10-100 feet in elevation below the average adjacent grade, and 5-30 feet in height below the bottom/first-level hitting-platform. The "top" of Slide #2 is the front edge of the range field surface located on the bottom/first-level hitting-platform that's 5-70 feet in elevation below the average adjacent grade. The range field surface is excavated, and graded downhill at a slope degree angle of about 1%, or more than 33%, to drop 5-30 feet in height for 45-285 feet/15-95 yards in distance to the ball drain inlet that's 10-100 feet in elevation below the average adjacent grade located between the 15 yard line and 95 yard line on the range field surface to form a downhill range field surface (hitting platform view) that sends golf balls hit from the hitting platform down the range field surface via gravity until the balls roll in the ball drain inlet, and go into a ball-bin, or depository so a ball return system can take the range golf balls back to the ball-dispensing location(s). The "bottom" of Slide #2 is the ball drain inlet on the range field surface located between the 15 yard line and 95 yard line that's 10-100 feet in elevation below the average adjacent grade, and 5-30 feet in height below the bottom/first-level hitting-platform.

The Tub above-ground range field surface is intentionally sloped/slanted longitudinally to form 2 slides of different length, and slope that face toward each other so golf balls roll in a ball drain inlet located on the range field surface between them. The "top" of Slide #1 is a back edge of a range field surface that's constructed to be 10-105 feet in elevation above the average adjacent grade, and 450-900 feet/150-300 yards in distance away from a bottom/first-level hitting-platform. The range field surface is constructed with a slope degree angle less than 1%, or more than 24%, for 165-855 feet/55-285 yards in distance to drop 5-75 feet (height) to a ball drain inlet that's 5-30 feet in elevation above the average adjacent grade located on the range field surface between the 15 yard line and 95 yard line to form an uphill range field surface (hitting platform view) that sends golf balls hit from a hitting platform back down the range field surface via gravity until the balls go in the ball drain inlet, and go to a ball-bin or depository so a ball return system can take the range golf balls back to the ball-dispensing location(s). The "bottom" of Slide #1 is the ball drain inlet on the range field surface between the 15 yard line and 95 yard line that's 5-30 feet in elevation above an average adjacent grade, and 5-30 feet in height below the bottom/first-level hitting-platform. The "top" of Slide #2 is the front edge of the range field surface on the bottom/first-level hitting-platform that's constructed 10-35 feet in elevation above the average adjacent grade. The range field surface is constructed with a slope degree angle of about 1%, or more than 33% for 45-285 feet/15-95 yards in distance to drop 5-30 feet (height) to a ball-drain-inlet that's 5-30 feet in elevation above the average adjacent grade located on the range field surface between the 15 yard line and 95 yard line to form a downhill range field surface (hitting platform view) that sends golf balls hit from the hitting-platform down the range field surface via gravity until the balls roll into a ball drain inlet, and go to a ball-bin, or depository so a ball return system can take the range golf balls back to the ball-dispensing location(s). The "bottom" of Slide #2 is the ball drain inlet on the range field surface between the 15 yard line and 95 yard line that's 5-30 feet in elevation above the average adjacent grade, and 5-30 feet in height below the bottom/first-level hitting-platform.

Golfers will like seeing golf balls automatically rolling back down the range field surface until they disappear underneath the hitting platform, or into a ball drain inlet, but they'll like seeing the carry distance for golf balls they hit even more while never seeing workers, water, machines or countless golf balls laying-out on range field surfaces for hours, or days with these useful golf driving range designs!

Current range design does not intentionally slope/slant range field surfaces longitudinally above, or below the average adjacent grade via excavation and/or grading, or construction so they're not flat anywhere, and allowing range golf balls to automatically return for reuse, and to allow for the faster, easier determination of carry distance for golf balls hit with golf clubs from a tee-area/hitting platform.

"Rapid Release and Reattach" Containment Net Systems

Current range design uses containment nets that touch, and are tied tight from top-to-bottom to poles, or ball damaging (chain-link) fences are used, or no fence is used to keep all the range golf balls contained. Cherry-pickers, lifts or other machinery is needed to get up high enough to tie nets tightly to poles that can be 140 feet in height (Top Golf). This "tying" puts tension on nylon containment nets that get weakened daily by weather which can cause them to split-open creating problems (liability, lost balls, reputation), and exposing homes, vehicles, people and more to being hit by errant golf balls going 100+ mph. Lawsuits can be costly, but so is buying new golf balls to replace the balls lost through torn containment nets. Repairs and/or replacement is costly, time-consuming, and never-ending as weather doesn't take a day-off from rotting tightly held containment nets that after being repaired or replaced go right back up the same current range design way that helped them to split-open in the first-place!

The present invention has 2 containment net systems that intentionally don't touch, get tied, or get close to any poles, or anything hard that could harm, or ruin range golf balls. The "Rapid Release & Reattach" containment net systems are available in a base design and a premium design that save time, money, headaches, and hassles in regards to the repair, replacement or installation of containment nets. A net-cable is threaded through the hem at top of containment nets for the entire length of the (3) sides (left-side/back-net-side/right-side) of the range field surface where containment nets will be installed. Net-cables are held by (snap into) spring-snap-hook-fasteners hanging from eye-bolts mounted under the end of angled supports (arms) above the range field surface extending 10-30 feet (length) from tall vertical supports setback 5-20 feet in distance on the east, west and back sides of range field surfaces. Base design containment net-cables are installed manually to eye-bolts on angled supports via a cherry picker or other lifting-machine, but they quickly attach, or release the containment nets in seconds to greatly reduce the time it takes to install, repair, or replace containment nets to save time, money, and headaches! The premium design is 100% automatic! Net-cables are attached to eye-bolts the same way, but the eye-bolts are connected to cables that go down inside the angled supports, and vertical supports on rollers until they reach a winder-device installed at the bottom of vertical supports. The winders are connected to a (wireless) power source. To install, repair or replace a containment net, a switch/button (up/down) is pushed on a controller to raise or lower containment nets attached to the cable until they drop/reach the range field surface. The net-cable quickly snaps "in" or "out" of each spring-snap-hook-fastener, and after a net-cable is installed on all spring-snap-hook-fasteners, the switch/button is pushed on the controller to raise containment nets back into position above range field surfaces! Containment net bottoms are securely attached directly to the range field surface below without touching or getting within 5 feet (distance) of supports/poles, perimeter-walls, or any ball-damaging surfaces. All it takes is the push of a button/switch to drop or raise containment nets in the shortest amount of time possible!

Containment nets hang down like a bathtub shower curtain allowing a soft, tension-free surface for range balls to deflect-off, then fall harmlessly to a range field surface. Nylon rope-lines are weaved 25-30 feet (width) apart from each other up/down containment nets the full-length of all (3) sides (left-side/back-net-side/right-side) of the range field surface where the containment nets are installed. Nylon rope-lines have elastic-cords on-the-end that hook to eye-bolts mounted (off-field) on the east, and west sides of the hitting platform, and at the back (off-field) of the range field surface helping containment nets to stay in-place on the side edge of the range field surface by creating elasticized tension up/down the containment nets for the longitudinal length on both sides (left/right) to keep them in-place while still being soft (nylon), and flexible (elastic-cords) so as to not harm any golf balls or containment nets. Secondary nylon rope-lines are used (off-field) behind containment nets that attach to the longitudinal nylon rope-lines and then attach to perimeter wall vertical supports to further keep containment nets on the side edges, and prevent them from blowing-out over range field surfaces on extremely windy days. The same method is used on the horizontal containment net at the back edge of the range field surface.

Soft, Rubbery "Non-Grass" Range-Field Surfaces

Current range design intentionally uses flat/natural range field surfaces that mostly use natural grass for range field surfaces, but costly synthetic/artificial grass/turf is being used more in recent years due to water-restrictions/drought conditions in some states. Current range design uses "hard" yardage signs or targets above or mounted on-top (Top Golf) of range field surfaces that harm golf balls hitting them. Flat range field surfaces make it difficult or impossible for golfers to see where a golf balls lands on a range field surface when balls are mostly landing 75-250 yards away in distance from the golfers.

Current range design uses yardage signs/targets above range field surfaces driven or cemented into-the-ground to withstand high winds, and the impact of 100+ mph golf balls hitting them! Current range design also uses real and fake greens with flag sticks in holes, or flag stick's stuck in-the-ground as targets, and some golf ranges have no yardage signs/targets on the range field surface, but one thing all current design golf driving ranges have in common is none of them have any distance demarcations (yardage lines), or yardage numbers marked "on" (painted, printed) their range field surfaces!

Current range design flat/natural range field surfaces create costly and frustrating issues! These range field surfaces need lots of water, lots of care (mowing, fertilizer, aeration, etc.), and more to stay healthy and green! If range field surfaces don't get enough water or none in drought states they become rock-hard, (cow) pastures until heavy (monsoon) rain turns the range field surface into a muddy mess. Golf balls plug (bury) and get covered in mud if the golf range is open, or they don't earn any money if the golf range is closed. Ball-pick-up-equipment, cart/tractor/mower tires can damage/ruin range field surfaces that are too wet or soft for anything to be on them! It's costly to be open for business as most or all balls get muddy requiring extra work to clean them for reuse, and the balls lost in the mud need to be replaced. Balls should not be picked-up until the range-field-surface is dry, but by then mud-covered golf balls plugged (buried) in the ground either partially or fully are harder to get-out of the ground and clean after the ground/mud is dry! Most golf ranges know this and most "close" because of it when rain storms come. They know it's too costly to open and that rain can turn a good range field surface into an ugly mess that might never look the same after it happens once. Water is a double-edge sword for many golf ranges as they needs lots of it to stay green, but too much at the wrong time can hurt or ruin them!

Current design golf ranges need lots of water, chemicals, workers, care, machinery and more to stay healthy! The present invention doesn't use or need any of these things, and can collect water to help increase (aquifer) ground-water levels in local communities and help water conservation efforts.

Current design golf ranges don't like too much rain, drought conditions, or water-restrictions! The present invention's range field surface is water-harvesting during rain storms, and doesn't need any water, chemicals, workers or machinery to be "good-looking" no matter how much or little it rains!

Current design (flat) range field surfaces can become mud-pit messes with (heavy) rain and many close rather than risk harm to range field surfaces, or muddy golf balls that plug and get lost. The present invention intentionally slopes range field surfaces so rain can't puddle or pool on them! Rain automatically returns for water-harvesting while giving golf balls a free wash before reuse. Heavy rain on the present invention's range field surface doesn't "close it", and actually increases business as other golf driving ranges aren't open or they don't have a roof to protect golfers from light or heavy rain!

Current design doesn't intentionally excavate/grade range field surfaces to below the average adjacent grade (subterranean) or slant them longitudinally so they're not flat to allow range golf balls to automatically return for reuse, and to allow faster, easier determination of carry distance for golf balls hit by golf clubs from a tee-area. The present invention does intentionally excavate/grade range field surfaces to be below the average adjacent grade (subterranean), and also slants them longitudinally so they're not flat anywhere allowing range golf balls to automatically return for reuse, and to allow faster, easier determination of the carry distance for golf balls hit by golf clubs from a tee-area.

Current design does not intentionally construct range field surfaces to be above the average adjacent grade (above-ground) and slant them longitudinally so they're not flat anywhere to allow golf balls to automatically return for reuse, and to allow for faster, easier determination of carry distance for golf balls hit with golf clubs from a tee-area. The present invention does intentionally construct range field surfaces to be above the average adjacent grade (above-ground), and slopes them longitudinally so they're not flat anywhere to allow golf balls to automatically return for reuse, and to allow faster, easier determination of the carry distance for golf balls hit with golf clubs from a tee-area/hitting platform.

Current design uses natural grass, synthetic/artificial turf, or dirt for all range field surfaces. The present invention uses rubbery, soft materials for range field surfaces, and no grass of any type!

Major/Minor Colored Distance Demarcations and Yardage Numbers Marked "on" the Range field Surface The present invention is contrary to current range design with no ball-damaging yardage signs above the range field surface! All distance demarcations (yardage lines) are marked on the range field surface. Yardages are always correct because the yardage-measurement-line never changes, so yardages never change! The present invention uses 10 inch (width) colored major distance demarcations at the 50, 75, 100, 125, 150, 175, 200, 225, 250, and 275 yard-lines, and 4 inch (width) white minor distance demarcations are used at the 60, 65, 85, 90, 110, 115, 135, 140, 160, 165, 185, 190, 210, 215, 235, and 240 yard-lines. Distance demarcations are marked (painted/printed) "on" range field surfaces so there's nothing ever above-ground for golf balls to hit that could harm or ruin them, including other golf balls!

The present invention uses 24 inch (height) yardage numbers at the 50, 75, 100, 125, 150, 175, 200, 225 250, and 275 yard lines. 12 inch (height) yardage numbers are at the 60, 65, 85, 90,110, 115, 135, 140, 160, 165, 185, 190, 210, 215, 235 and 240 yard lines. All yardage numbers are marked (painted/printed) "on" range field surfaces, so there's nothing ever above-ground! Range field surfaces are intentionally sloped downhill from the back-net/back edge of a range field surface towards the tee-area/hitting platform to form an uphill range field surface that tilts back toward golfers hitting balls at a tee-area/hitting platform allowing colored distance demarcations and yardage numbers to be as visible as possible for golfers at the hitting platform elevated above the front-part of the range field surface!

A tilted-back range-field-surface acts as a background/back-drop making it easier see a golf ball flying in the air, and where it lands on the range field surface. The colored distance demarcations with corresponding yardage number allow for fast, easy determination of the carry distance for golf balls hit from a tee-area/hitting platform especially without countless other golf balls sitting on the range field surface that make it harder to see where balls land or know which ball was just hit. The invention uses great hitting mats that measure 5 feet (length) by 5 foot (width), and they're rotated/turned weekly to last 4 times longer, and also so "ruts" don't develop in the hitting-zone. Turning, rotating or replacing a hitting mat doesn't move the yardage-measurement-line, so golfers know all distance demarcations, and yardage numbers on the range field surface are always correct when they warm-up or practice!

Current range design doesn't use major, or minor distance demarcations, or yardage numbers marked (painted/printed) on range field surfaces, or going horizontally across. Flat range field surfaces make it difficult or impossible to see demarcations, let alone see where a golf ball lands with hundreds or thousands of other golf balls laying around waiting to get hit while being slow-cooked by the sun! The present invention has them to be useful, and to benefit golfers wanting a better practice experience!

Current range design has many problems that show the present invention is contrary, different, and more useful. Top Golf has round, colored, hard plastic, ball-damaging targets mounted on-top of its range field surface, but there are no lines or numbers marked anywhere on their range field surface! If a golf ball hit at Top Golf lands next to the fake (white) sand-traps on the left-side of the range field surface, how far did that ball carry? There's no distance demarcations, or yardage numbers anywhere so it's impossible to know, and you can only guess! The only way to get carry yardage is if your golf ball goes down the colored target that damages or ruins balls instantly which is one reason 30-70% of their golf balls are "bad" so they don't go (carry) as far as a good ball! The present invention is the first and only golf range design with distance demarcations, and yardage numbers marked "on" and horizontally across a tilted-back range field surface that automatically removes (returns) golf balls from the range field surface after each shot so balls don't get hit, cooked, damaged/ruined to make them stay (last) in better (good) condition longer to be useful to golfers wanting a better warm-up and/or practice session!

Some current range designs use Top-Tracer or Trackman technology, but golfers pay extra for it and the yardages the technology gives via electronic devices are only accurate (true) if the range golf balls are "good" or in newer condition! The problem is current range design damages or ruins golf balls instantly or sooner than they should be due to all the hard things on or around range field surfaces that golf balls hit over and over, or sit in the sun/freezing cold for hours/days getting ruined waiting to get picked-up or hit by another golf ball to harm both which is why many/most of the range golf balls (30-70%) are "bad" (marshmallows). Golfers can pay extra to get bad yardages for 30-70% of the golf balls they hit, but golfers don't play with bad golf balls on a golf course so practicing with them isn't useful! Current range design uses hard above-ground yardage signs, targets, big rocks, trees, poles with range field surfaces in drought areas (no water) as hard as a paved road that damage or ruin range golf balls, but it's not always easy to know if the golf ball you're about to hit was previously damaged "internally" from previously hitting a pole, tree, or yardage sign so the Top-Tracer/Trackman yardage golfers pay extra money for isn't accurate or true many times! The only time Top-Tracer/Trackman yardages are "good" or useful is when the range golf ball is "good" or new! Bad carry distance will cost golfers on the golf course when the (new) ball they're playing flies 10-20 yards farther into a lake, sand-trap or out-of-bounds because many of the range balls they hit while warming-up or practicing were bad, and they didn't know the carry distance was bad! Top-Tracer/Trackman don't tell you the ball you just hit 170 yards on the driving range with a 6-iron was damaged previously by golfers who hit a pole, sign, or another ball slow-cooking on the ground! Current golf range design is in fact it's own worst enemy!

The present invention makes it easier to see golf balls land as there aren't any golf balls sitting on range field surfaces, and golfers get a birds-eye-view! They're above the front-part of the range field surface, and below the rest of it, so it's easier to see range golf balls land on a clean range field surface without lots of other golf balls laying around, and it also tilts-back toward the tee-area/hitting platform creating a great backdrop making it easier to see where balls land out on the range field surface. Balls will bounce and roll-around on a smooth rubbery range field surface till gravity makes them disappear. Golf balls last longer if they don't hit hard things, land on a soft range field surface, and exit after every shot so they don't sit for hours/days in all types of weather waiting to be hit by other range golf balls!

The most important thing good or professional golfers want to know when they hit a golf ball at a golf range or on a golf course is the carry distance for that golf shot. They want to know it for every club in their bag (except putter) so they can shoot better scores. Watch the PGA Tour on TV and you'll see caddies/players talking about how far they need to carry a golf ball to fly over a lake, sand-trap, or to land next to the hole. It's about carry distance, and the direction they want to hit a ball comes second!

Major distance demarcation colors are: 50 yard-line is silver, 75 yard-line is black, 100 yard-line is red, 125 yard-line=purple, 150 yard-line=white, 175 yard-line=pink, 200 yard-line=blue, 225 yard-line=orange, 250 yard-line is yellow, and the 275 yard-line is gold.

Range Golf Balls Last Longer Due to the Present Invention's Design

Current range design leaves countless golf balls laying-on flat range field surfaces for hours or days getting weathered (ruined). How do golf balls lose their color? The sun slow-cooks them for hours each day in current range design's frying-pan of a range field surface! Golf balls faded in color are bad and don't fly as far, or as straight (no longer 100% round), and they're harder to see flying in the air!

Golf driving ranges sell "buckets-of-balls" from when they open till closing. Range golf balls need to be picked-up or they sell-out (range closed). Current range design uses ball-pick-up-equipment pulled/pushed by carts or tractors to pick-up golf balls from range field surfaces, or workers use shag bags/ball-tubes to hand-pick a range field surface, but this means "closing" a golf driving range so the workers don't get injured by golf balls hit from the tee-area/hitting platform. Shag bags/ball-tubes don't save golf balls from harm! These pick-up tools have metal-teeth that grab golf balls in a not-so-gentle-way that can scratch, or cut a ball. Range golf balls also are ruined (cut) by mowers that didn't see them in the tall grass, or golf balls get run-over by tires that bury them in the turf so they can't be picked-up!

Summer temperatures in many parts or the USA can reach or stay 95-100+ degrees for weeks at a time. Phoenix, Arizona had 144 days of 100+ degree weather in 2020, and 31 days in-a-row of 110+ degree temperatures recently in July 2023. Winter brings (freezing) cold, wet weather for weeks so it's easy to see how weather (temperature swings) can deteriorate everything at current design outdoor golf ranges! Range golf balls slow-cook on range field surfaces in high heat or freeze in cold weather daily non-stop which is why golf balls get ruined sooner than they should! Put some new golf balls in a pan, then put them in an oven at 100 degrees, and bake for 10-12 hours daily a few weeks to see the physical damage as the golf balls change in color, then hit the well-cooked golf balls to see the internal damage as they won't go as far in distance, and warped golf balls fly crooked (curve left/right). This IS how bad it is for golf balls to sit on range field surfaces for hours/days in the sun! It harms/ruins golf balls and current range design allows this daily, turning new or good golf balls into bad marshmallows too soon! Golf balls are "sitting ducks" on current design range field surfaces waiting for other balls to hit them, so both balls are harmed in one-shot! Then both balls sit there waiting to be hit again! Tee-areas/hitting mats, golf balls, containment nets, range field surfaces, and golfers all take a beating from the weather if they're not protected. Many states (west/southwest) have drought issues/water-restrictions that don't allow watering the range field surface (tee-areas only) turning them into hard-pan, barren, pastures that harm or ruin golf balls when they land, and it's costly for range owners to buy new balls each month to replace the 50,000 range balls ruined the previous month. It's not fun or good practice hitting golf balls that fly shorter or crooked. Golfers don't play "bad" balls on golf courses, and they don't like practicing with them either! They want good range golf balls to hit like the ones they play with on the golf course!

Current range design is harmful to range golf balls! Damaged balls don't fly as far or straight as a good ball! When a golf ball hits roads, trees or hard things on a golf course, it's replaced immediately because the "Rules Of Golf" say, "it's unfit for play". At the President's Cup (Sep. 23, 2022), Jordon Speith's golf ball hit a TV camera that actually stopped his ball from going in a lake. There was no penalty, but Jordon got to replace his ball with a "new" ball due to the possible "internal damage" his ball had from hitting the TV camera. Golf balls get replaced on golf courses fast when they hit hard things, but not on golf driving ranges! Balls get damaged or ruined hitting poles, yardage signs, targets, rocks, trees, ball-pick-up-equipment, mowers, tractors, hard-pan ground, landing on other balls, or sitting on range field surfaces for hours/days getting ruined and needing to be replaced, but it's too costly to do this monthly!

Current range design uses hard things above-ground on or around range field surfaces for golf balls to hit such as metal/wood yardage signs (50, 100, etc.), or targets that golfers aim for (try to hit), so balls either hit the metal/wood yardage sign/target (damaging the ball) or the ball misses, but now it sits on-the-ground near a sign/target other golfers are trying to hit waiting for another ball to hit it while it slow-cooks for hours/days waiting to be picked-up, or waiting to get cut by a grass-mower that didn't see the ball in the grass. Yardage signs above the range field surface damage or ruin golf balls, but other golfers aim for the same sign/target so more golf balls sit on-the-ground all-around these ball-damaging signs/targets to increase the odds of golf balls being hit many times by many golfers hitting many golf balls at the same signs/targets accurate about 4 times a year! It's a bad design that hurts (destroys) itself.

The present invention only uses soft, rubbery, range field surfaces for range golf balls to land-on, then the balls leave automatically and immediately to last longer while golfers get accurate or true yardages all-the-time with distance demarcations, and yardage numbers that never change or move!

The present invention's design helps range golf balls to stay in better condition and last longer as they never hit hard things on range field surfaces. Balls don't sit on-the-field for hours, or minutes in 100 degree heat or 38 degree (freezing) cold waiting for balls to hit them, grass-mowers to cut them, or a cart, tractor, or ball-pick-up-equipment to run them over! The present invention's range field surface doesn't have any hard things like current range design such as metal or wood signs/targets, poles, trees, hard-ground, or rocks for balls to hit! The present invention is in fact contrary to current range design!

Does the present invention need workers, machines or ball-pick-up gear to get range balls? No!

Does the present invention's range field surface let golf balls lay around for hours or days?

No!

Does the present invention's range field surface have any ball-damaging (hard) things? No!

Does the present invention have any containment nets that touch or get tied to poles? No!

The present invention's design is completely contrary to current range design in many ways. It protects golfers, containment nets, golf balls, hitting mats, and range field surfaces better than any golf range design eliminating the need for water, workers, mowers, ball-pick-up-equipment and all the daily problems/costs other golf ranges can't avoid while creating a water-harvesting, self-cleaning golf range!

True Tier Multi-Level Hitting Platform

Current range design uses multi-level hitting platforms that are stacked above (on-top of) each other. For example, a golf driving range using a two-level hitting platform will have the second-level hitting platform positioned directly above the bottom/first-level hitting platform. Golf driving ranges with a three-level hitting platform have the second-level hitting platform directly above (on-top-of) the bottom/first-level hitting platform, and the third-level hitting platform is directly above (on-top of) the second-level hitting platform in a stacked-up design.

Current range design stacked multi-level hitting platforms change the carry distance for golf balls hit with golf clubs for every level of a stacked multi-level hitting platform. For example, if a golf ball is hit with exactly the same amount of force from each level of a current design three-level hitting platform, the golf ball hit on a bottom/first-level hitting platform would carry the shortest distance, the golf ball hit on the second-level would carry farther, and the golf ball hit on the third-level would carry the farthest. As another example, a golf ball hit to carry 100 yards in distance from the bottom/first-level hitting platform would carry farther, or more than 100 yards in distance from the second-level hitting platform, and it'd carry even further in distance from the third-level hitting platform. This would continue for each level of a current design multi-level hitting platform no matter how many levels are stacked above/on-top of each other.

The height difference between each level of a stacked multi-level hitting platform determines how much farther golf balls hit with equal force will carry in comparison to the level(s) below, and/or above-it. For example, if the second-level of a multi-level hitting platform at golf range #1 is 10 feet in height above the bottom/first-level, and the second-level of a multi-level hitting platform at golf range #2 is 16 feet in height above the bottom/first-level, a ball hit with equal force from the second-level at golf range #2 would carry about 6 feet (2 yards) farther in distance than a golf ball hit equally from the second-level at golf range #1 due to the 6 foot height difference of the second-level hitting platforms.

Because carry distance is different for each level of a current range design stacked multi-level hitting platform, distances (yardages) measured to yardage signs/targets on the range field surface are different for every level of a stacked multi-level hitting platform making yardages accurate, and useful only for the level of a hitting platform they're measured from (usually a bottom/first-level), and wrong or useless for all other levels of the same hitting platform. If hitting platform levels are 15-20 feet apart in height from each other the (carry) distance difference between a bottom/first-level, and a third-level or fourth-level can be substantial (45-80 feet difference=15-26 yards) which makes putting yardages or yardage numbers on a range field surface useless as the yardages are only accurate for the level of a hitting platform they're measured from, and wrong for all the other levels of the same hitting platform.

Some current design golf driving ranges with stacked multi-level hitting platforms offer Top-Tracer or Trackman technology that show carry distance for golf balls hit with golf clubs after the ball lands, but golfers pay extra for it, and the carry distance these electronic devices show is only accurate if the range golf ball being hit is in new or "good" condition, but as previously explained, current range design damages, or ruins range golf balls instantly or sooner than they should to make many of the golf balls (30%-70%) at most golf driving ranges so bad they're not close to being in new or good condition.

The present invention uses an innovative, useful multi-level hitting platform system called the "True Tier Multi-Level Hitting Platform" that allows golf driving ranges wanting a multi-level hitting platform to put distance demarcations (yardage lines) and yardage numbers on the range field surface, and know the laser-measured yardages are accurate (true) no matter which level of the hitting platform a golfer chooses to hit their range golf balls from.

The present invention marks a 2-4 inch (width) yardage-measurement-line (YML) on the floor underneath the front-part (hitting area) of all the hitting mats on the bottom/first-level hitting platform. The YML goes horizontally across the entire (concrete, etc.) floor about 15-24 inches in length behind the front edge of a range-field-surface. Any distance demarcations wanted for a range field surface are laser-measured from the YML center so distance demarcations and corresponding yardage numbers on a range field surface are accurate (true) from the YML on the bottom/first-level hitting-platform.

The present invention then uses a "rule of thumb" measurement method for additional hitting platform levels above the bottom/first-level of the multi-level hitting platform so distance demarcations and corresponding yardage numbers marked on the range field surface are the same distance no matter which level of a multi-level hitting platform golfers hit golf balls or a bucket of balls from!

The same rule of thumb is used for elevation change when playing a golf course. For example, when a golfer has an uphill shot to a hole (flag) or target that's 100 yards in distance away, and about 30 feet in height above them, they should add 1 foot of distance for every 1 foot of height the hole (flag) or target is above them in elevation to get an accurate carry distance (yardage) for the shot they're about to hit. In this case the hole is 30 feet (height) above, so the golfer should add 30 feet (10 yards) of distance in order to carry their golf ball the 110 yards in distance this shot will play due to the 30 foot elevation difference between the golf ball and hole (flag) or target above them. This rule of thumb is the same for downhill golf shots. If a hole/flag/target is 30 feet below the golf ball, golfers should subtract 30 feet of distance, or 10 yards to carry the golf ball the correct distance, so for a 100 yard (distance) shot that has a 30 foot drop in height, golfers should choose a golf club that will carry the ball 90 yards in distance.

The present invention's "True Tier Multi-Level Hitting Platform" offers several height/setback choices to fit different locations/situations for golf driving ranges wanting multi-level hitting platforms. The lowest height/setback is "8 feet by 8 feet", and highest height/setback design is "30 feet by 30 feet" with every size in-between (9 feet by 9 feet, 10 feet by 10 feet, 11 feet by 11 feet, 12 feet by 12 feet, 13 feet by 13 feet, 14 feet by 14 feet, 15 feet by 15 feet, 16 feet by 16 feet, 17 feet by 17 feet, 18 feet by 18 feet, 19 feet by 19 feet, 20 feet by 20 feet, 21 feet by 21 feet, 22 feet by 22 feet, 23 feet by 23 feet, 24 feet by 24 feet, 25 feet by 25 feet, 26 feet by 26 feet, 27 feet by 27 feet, 28 feet by 28 feet, 29 feet by 29 feet) available so every golf driving range can select the size and design that best fits their needs!

For example, a golf range with the present invention's True Tier Multi-Level Hitting Platform "10 foot height by 10 foot setback" design would have a second-level hitting-platform 10 feet in height above the bottom/first-level hitting-platform with a YML setback 10 feet in distance from the YML marked on the bottom/first-level hitting-platform allowing distance demarcations, and yardage numbers on the range field surface to be approximately the same distance for both levels of the hitting platform due to the rule of thumb. The second-level hitting platform also has a deck (roof) at its front edge 13-15 feet in distance that declines at about a 1.5 degree slope angle extending 3-5 feet in distance over the golfers on the bottom/first-level hitting platform to shade and protect them. If a hitting platform has a third-level it'd be 10 feet in height above the second-level hitting platform, and setback 10 feet in distance from the YML on the second-level hitting-platform so distance demarcations, and yardage numbers on the range field surface are the same distance for all levels of the hitting-platform. A third-level hitting-platform would also have a deck/roof at its front edge 13-15 feet in distance declining at about a 1.5 degree slope angle extending 3-5 feet in distance over golfers on the second-level hitting platform to shade/protect them. This method would continue for a fourth-level or all additional levels so distance demarcations and yardage numbers on the range field surface are the same for all levels of a multi-level hitting platform due to this rule of thumb method the present invention is the first to use because it's useful, but it's not obvious or at least one other driving range in the USA would be using it!

Many golf driving ranges won't choose the "8 foot height by 8 foot setback" design, but the present invention still offers it as the invention uses only soft, rubbery material for range field surfaces, so some golf ranges might want this design as there's deck to shade/protect golfers on lower-levels that inclines upward at a 7.13 degree slope angle to increase roof height by 1 foot over the 8 foot distance to allow golfers on a hitting platform level below 9 feet of height overhead, but golfers 6 feet in height or taller wouldn't be allowed to use the bottom/first-level, or any level of a hitting-platform with the same 9 foot height above golfers as there's not enough clearance for golfers 6 feet in height or taller to swing a golf club (driver) 45-48 inches in length. The "9 foot by 9 foot" design wouldn't allow golfers 7 feet in height or taller to use similar "9 foot by 9 foot" levels of a hitting platform for the same reason, but less than 200 people in the U.S. are 7 feet in height or taller, and 15% are 6 feet in height or taller, so it wouldn't affect many, but signs would need to be posted so golfers know about any height restrictions.

For example, a golf range with a "True Tier Multi-Level Hitting Platform" "8 foot height by 8 foot setback" design has a second-level of a hitting platform that's 8 feet in height above a bottom/first-level hitting platform, and it's setback 8 feet in distance from the YML marked on the bottom/first-level hitting platform allowing distance demarcations, and yardage numbers on the range field surface to be the same distance for both levels due to the rule of thumb. The second-level hitting platform has a deck (roof) at its front edge 13-15 feet in distance that inclines upwardly at about a 7.13 degree slope angle extending 3-5 feet in distance over the golfers on the bottom/first-level hitting platform to shade/protect them, and increase the height above golfers on the bottom/first-level by 1 foot in height from 8 feet to 9 feet. A third-level would be 8 feet in height above the second-level hitting platform, and setback 8 feet in distance from the YML on the second-level hitting platform to make distance demarcations/yardage numbers on the range field surface the same distance for all three levels of the hitting platform, and it'd have a deck/roof inclining upwardly at about a 7.13 degree slope angle extending 3-5 feet in distance over the golfers on the second-level hitting platform to shade/protect them, and increasing the height above golfers on the second-level hitting-platform by 1 foot in height from 8 feet to 9 feet. This method would continue for a fourth-level and all additional levels so distance demarcations/yardage numbers on the range field surface are the same for all levels of the hitting platform.

Furthermore, the innovative, inventive technical feature of the present invention contributed to some the surprising results. For example, the following description illustrates some surprising results of embodiment's of the present invention.

Surprising Results

The present invention allows golf balls hit from a tee-area/hitting platform out to a range field surface to automatically return back to the same tee-area/hitting platform without needing any workers, ball-pick-up-equipment, or anything!

The present invention uses rubbery, soft (recyclable) materials instead of natural grass, or synthetic/artificial grass for its range field surface which greatly reduces costs and allows range field surfaces to last years long than natural grass, and/or synthetic/artificial grass.

The present invention uses rubbery, soft, recyclable material for range field surfaces instead of natural, synthetic, or artificial grass allowing the surfaces to harvest or collect water.

The present invention allows golf driving ranges in the west/southwest could to go from being water-users to waterless, water-harvesting/collection sites, and better golf driving ranges at the same time!

The present invention uses rubbery, soft, recyclable materials for the range field surface allowing range golf balls to last longer as both are similar materials, so balls will land harmlessly on them!

The present invention permanently eliminates the never-ending-expenses, daily problems, hassles and headaches other golf driving ranges can't avoid!

The present invention protects golfers, golf balls, containment nets, hitting mats and range field surfaces so much better from weather than current design flat ranges!

The present invention's subterranean golf range designs make it cooler below-ground when it is hotter above-ground, and warmer below-ground when it is colder above-ground.

The "Rapid Release & Reattach" containment net system design(s) saves money on installations, repairs, or replacement of golf range containment nets!

The "Rapid Release & Reattach" containment net system allows golf balls to last longer as golf balls can't hit poles or hard surfaces.

The "Rapid Release & Reattach" containment nets last longer hanging without tension or being tied top-to-bottom, as the tension is what contributes to containment nets splitting open sooner!

The present invention uses an above-ground, subterranean, or combination of both (semi-subterranean) range field surface that is intentionally sloping/slanting back towards a tee-area/hitting platform which allows the range field surfaces to be seen from a tee-area/hitting platform like never before, so putting horizontal distance demarcations and corresponding yardage numbers "on" range field surfaces now makes sense as it would allow for fast, easy, and accurate determination of carry distance for golf balls hit with golf clubs, without the use of, or need for any electronic device.

Current range designs use yardage signs measured from a single line on natural grass tee areas that are rarely accurate.

The present invention may use a "True Tier Hitting Platform" system that allows for accurate yardage determination.

The present invention doesn't allow golf balls to sit for minutes, hours, or days on range field surfaces in all types of weather waiting for other golf balls to hit/harm them which helps golf balls to last longer, and allows golfers better golf balls to hit while warming-up or practicing!

Any feature or combination of features described herein are included within the scope of the present invention provided the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING

Features and advantages of the present invention will become apparent from consideration of the following detailed description presented in connection with the accompanying drawings in which.

DETAILED DESCRIPTION OF THE INVENTION

Figure 1:
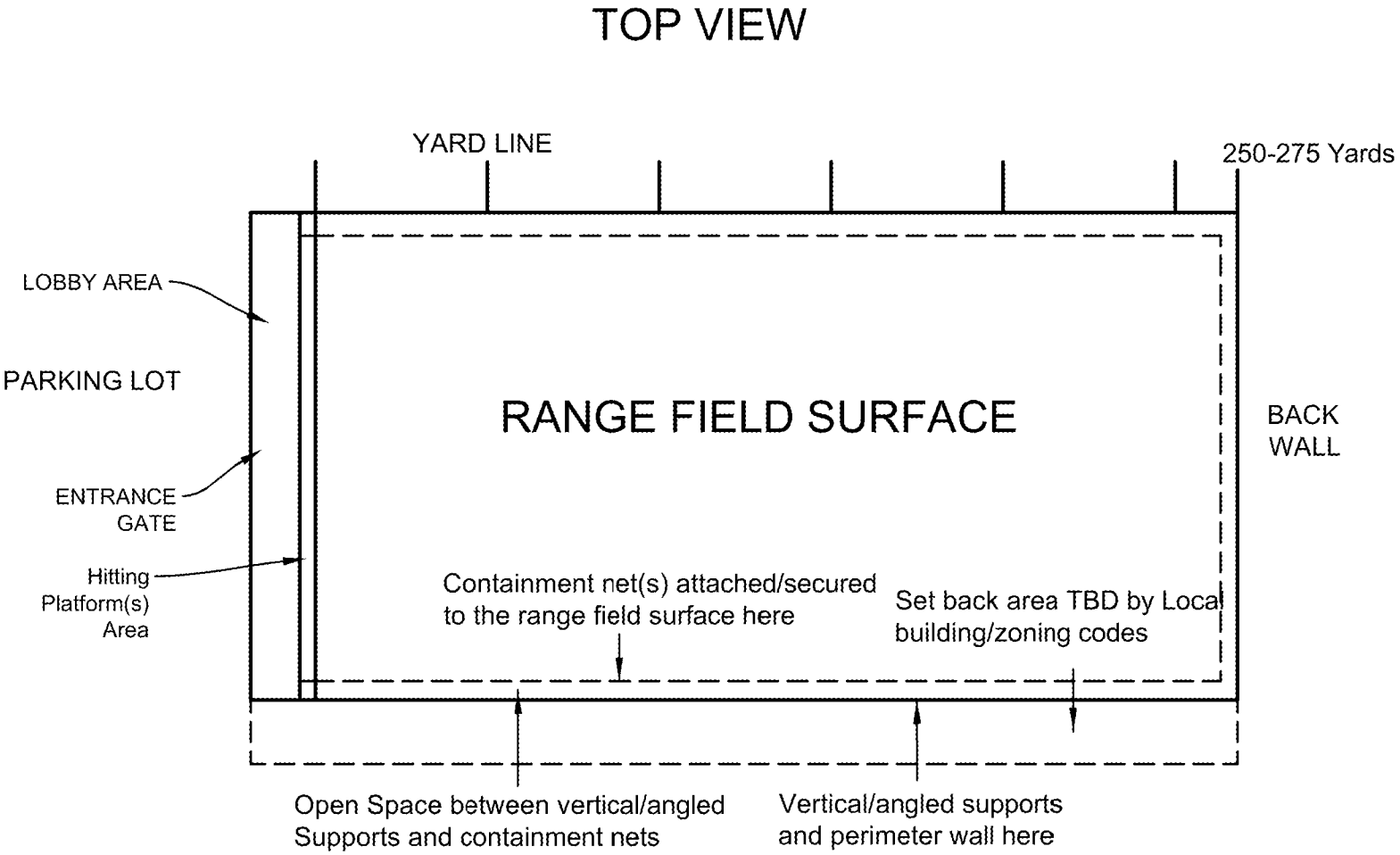
FIG. 1 shows an illustration of aspects of an embodiment of the present invention.
Figure 2:
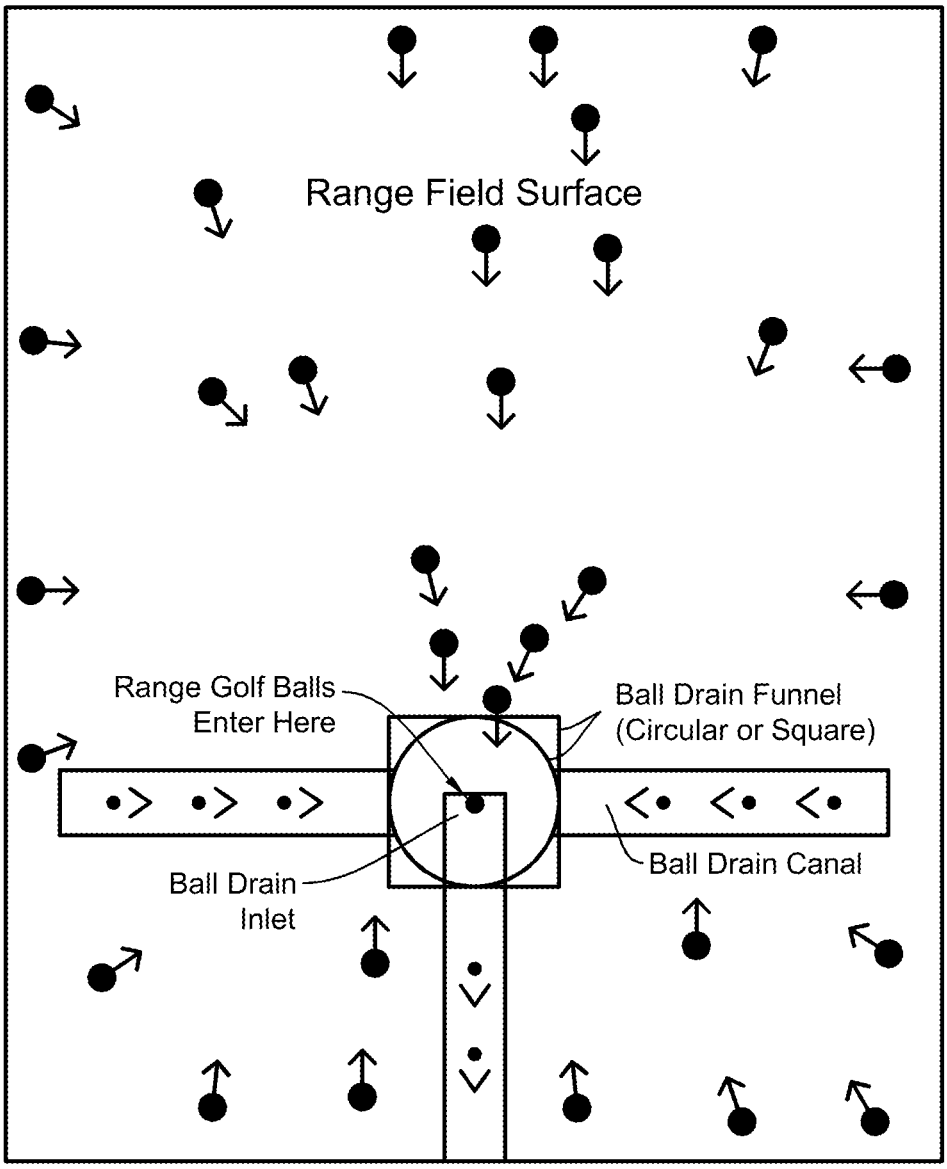
FIG. 2 shows an illustration of aspects of an embodiment of the present invention.
Figure 3:
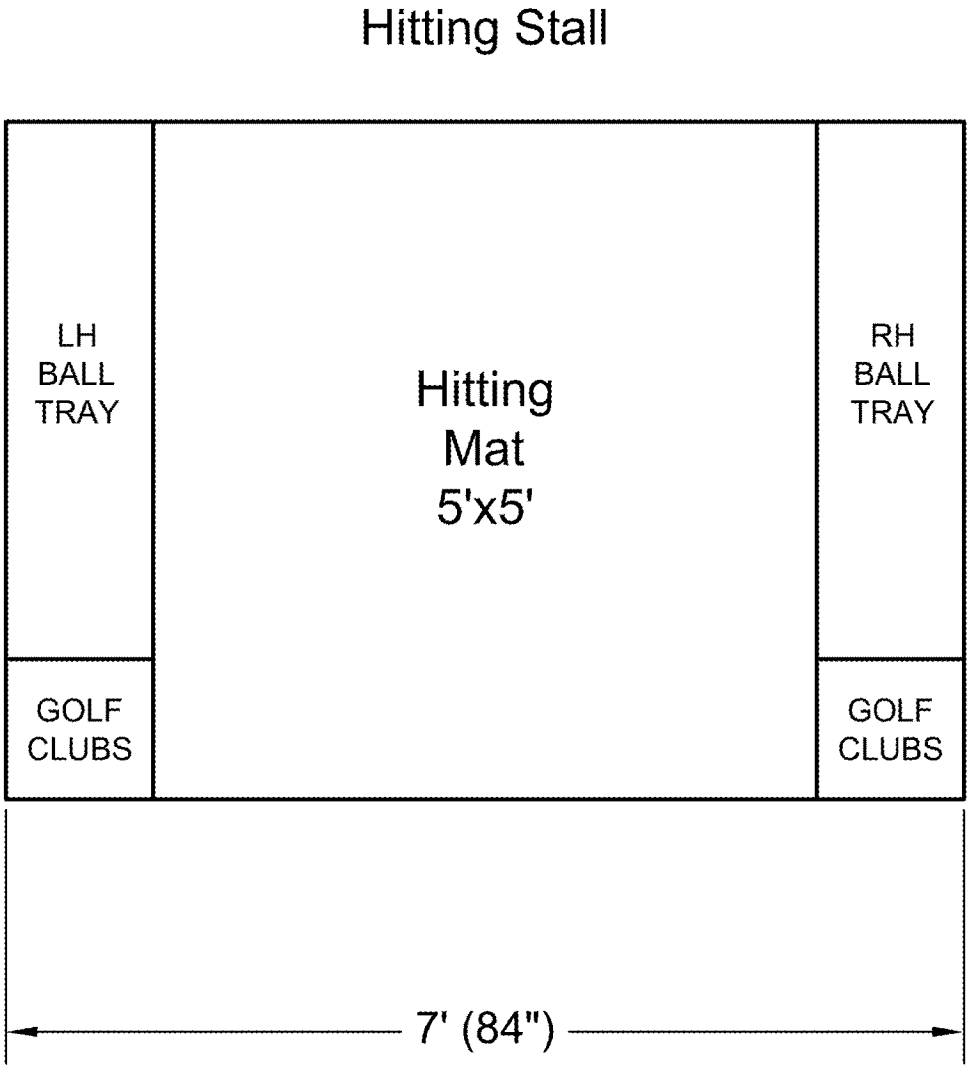
FIG. 3 shows an illustration of aspects of an embodiment of the present invention.
Figure 4:
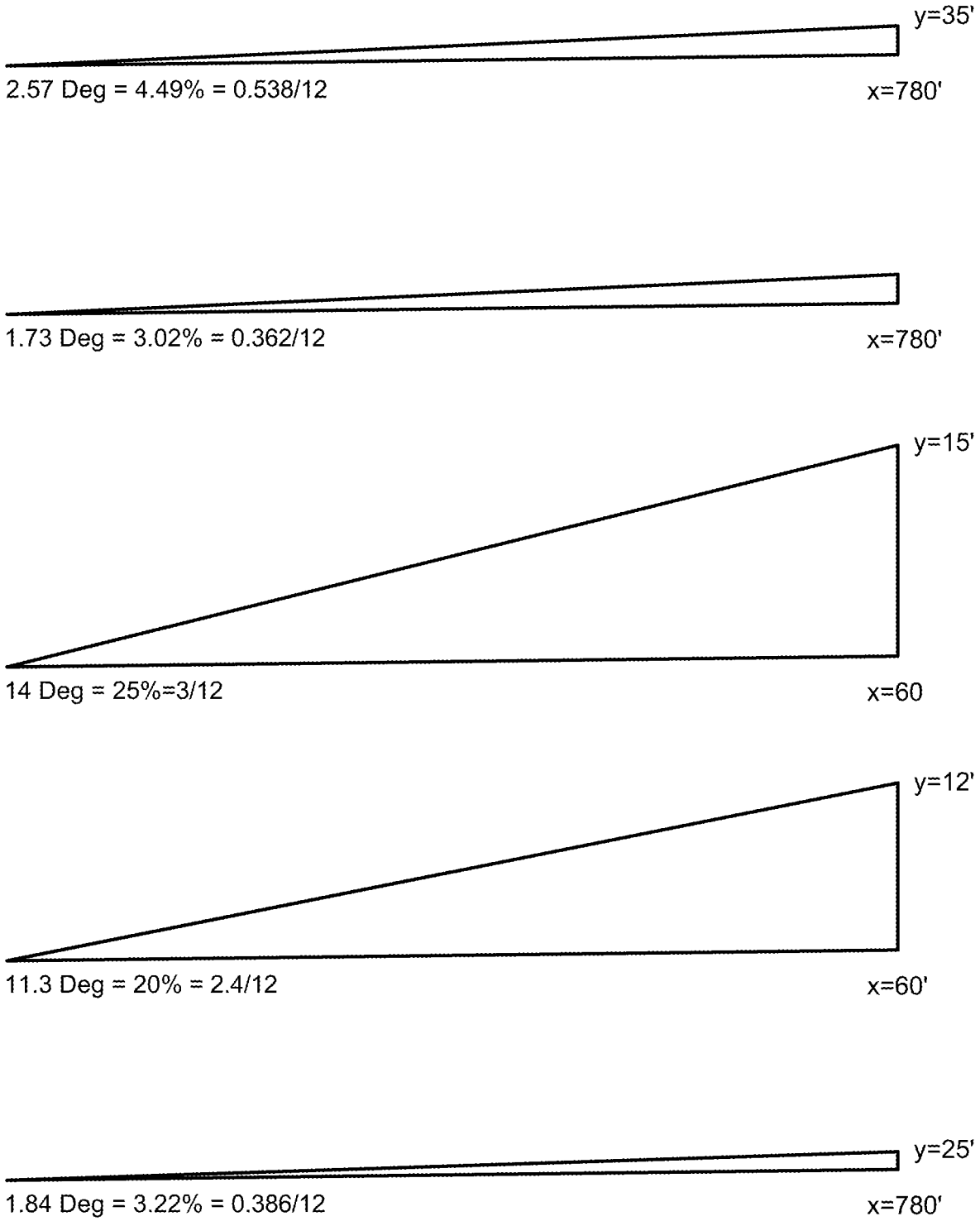
FIG. 4 shows an illustration of aspects of an embodiment of the present invention.
Figure 5:
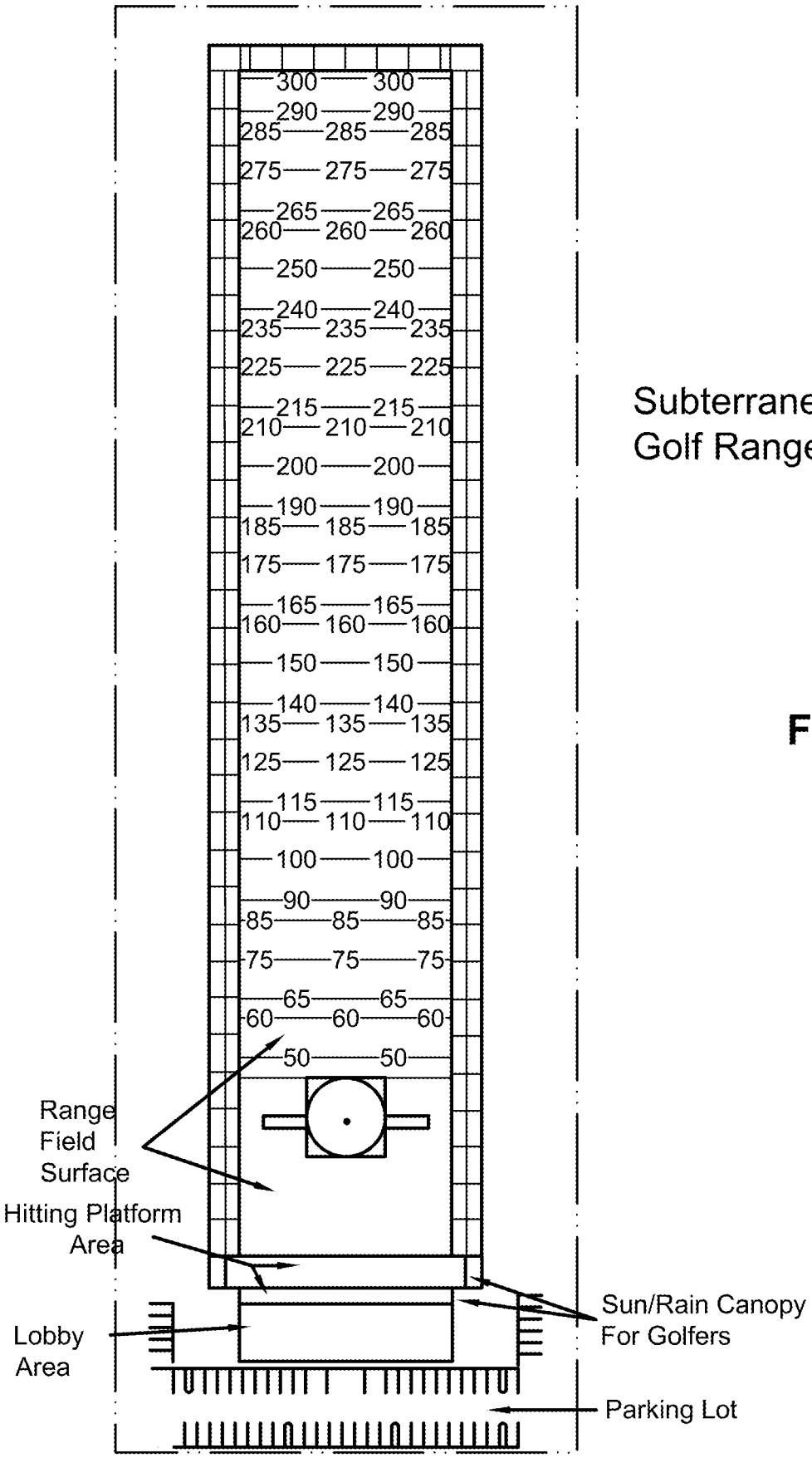
FIG. 5 shows an illustration of aspects of an embodiment of the present invention.
Figure 6:
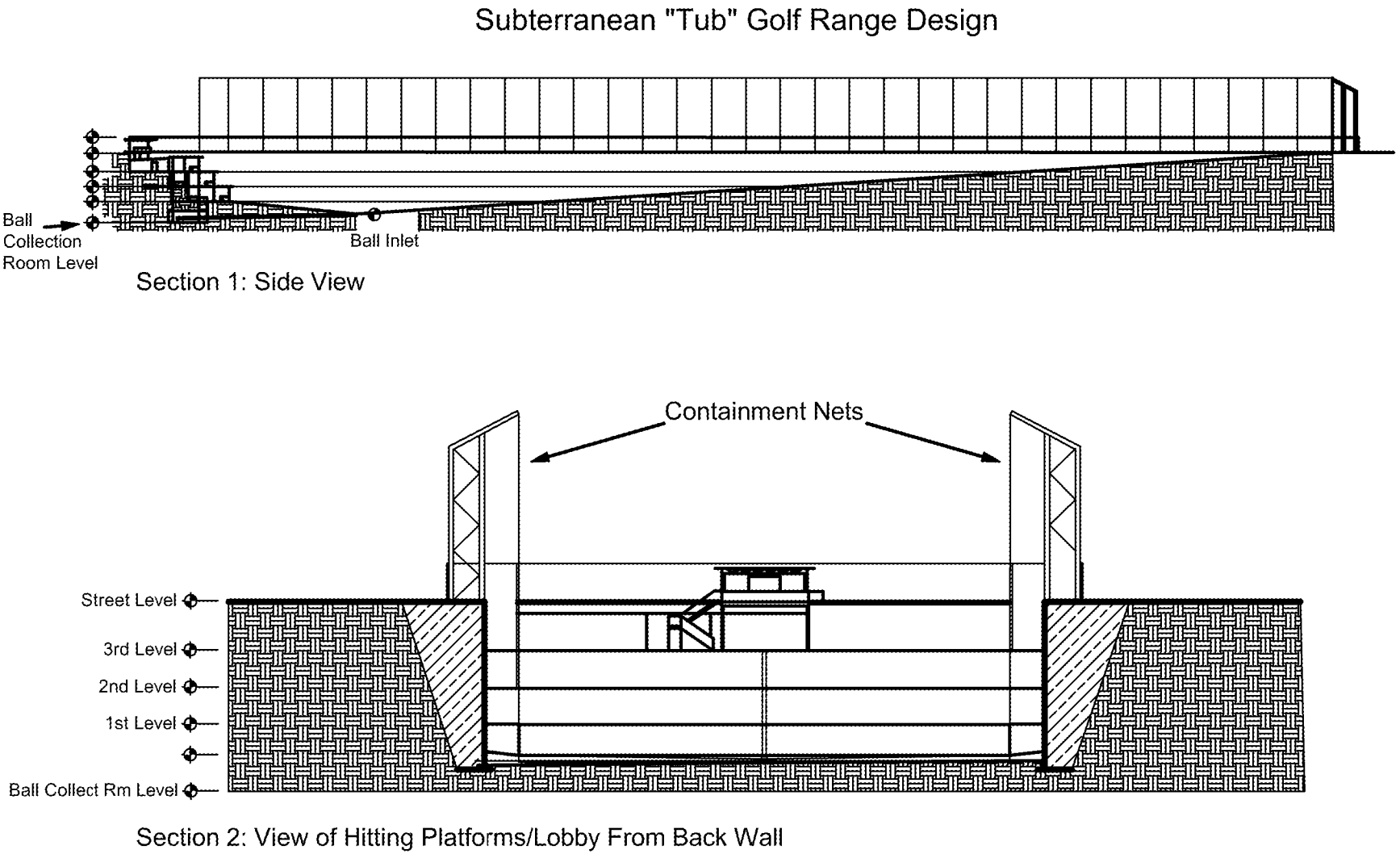
FIG. 6 shows an illustration of aspects of an embodiment of the present invention.
Figure 7:
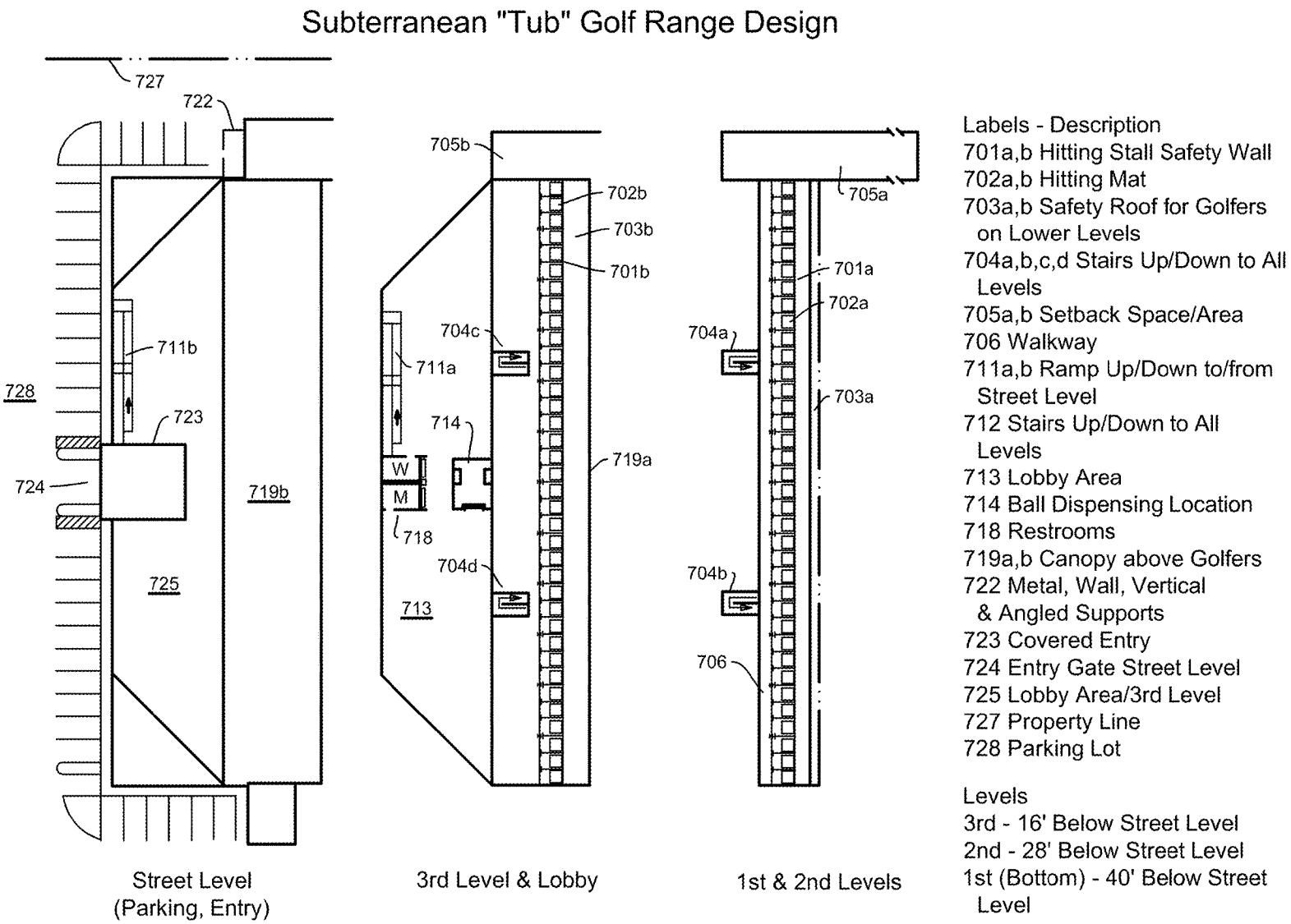
FIG. 7 shows an illustration of aspects of an embodiment of the present invention.
Figure 8:
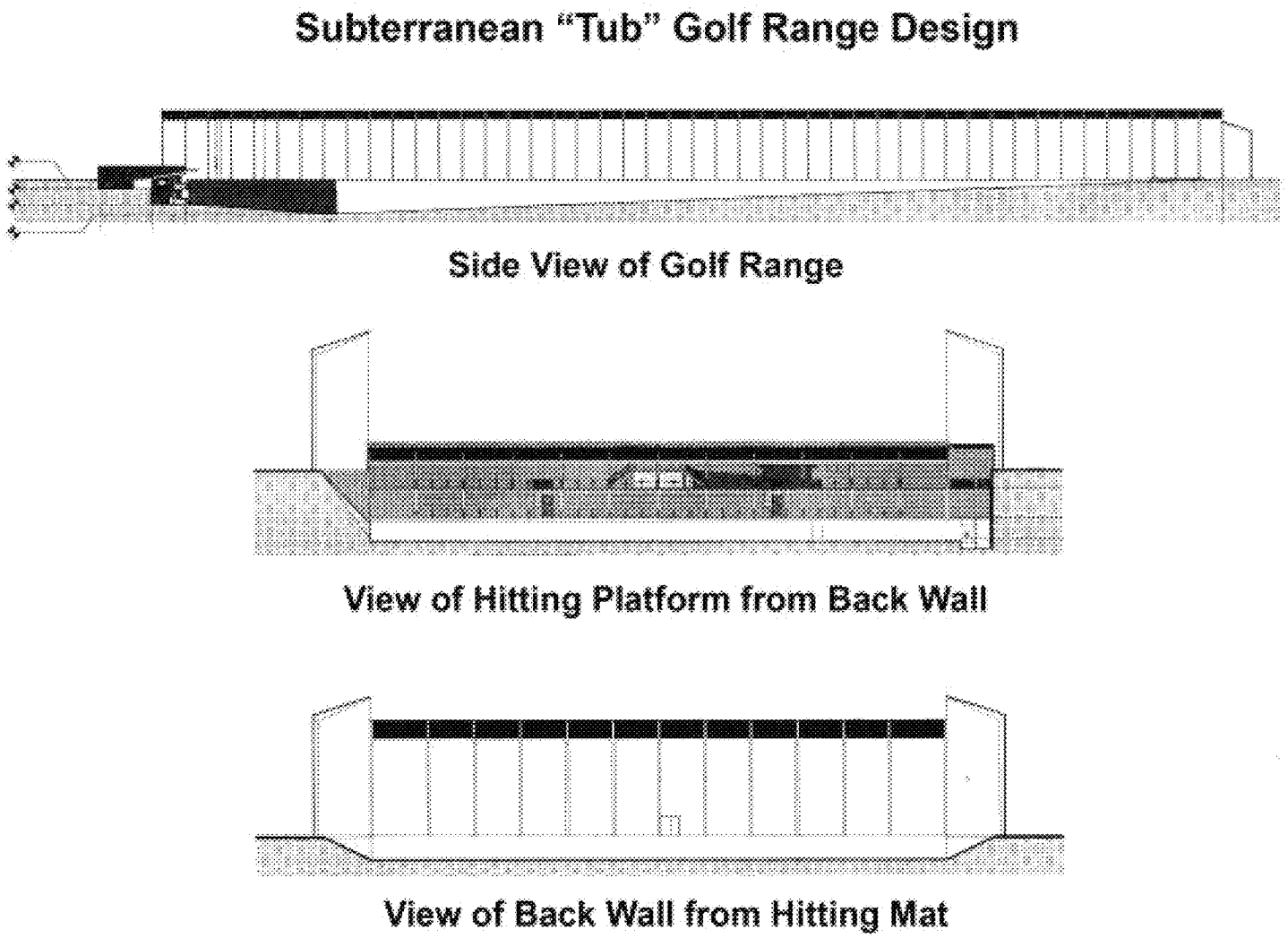
FIG. 8 shows an illustration of aspects of an embodiment of the present invention.
Figure 9:
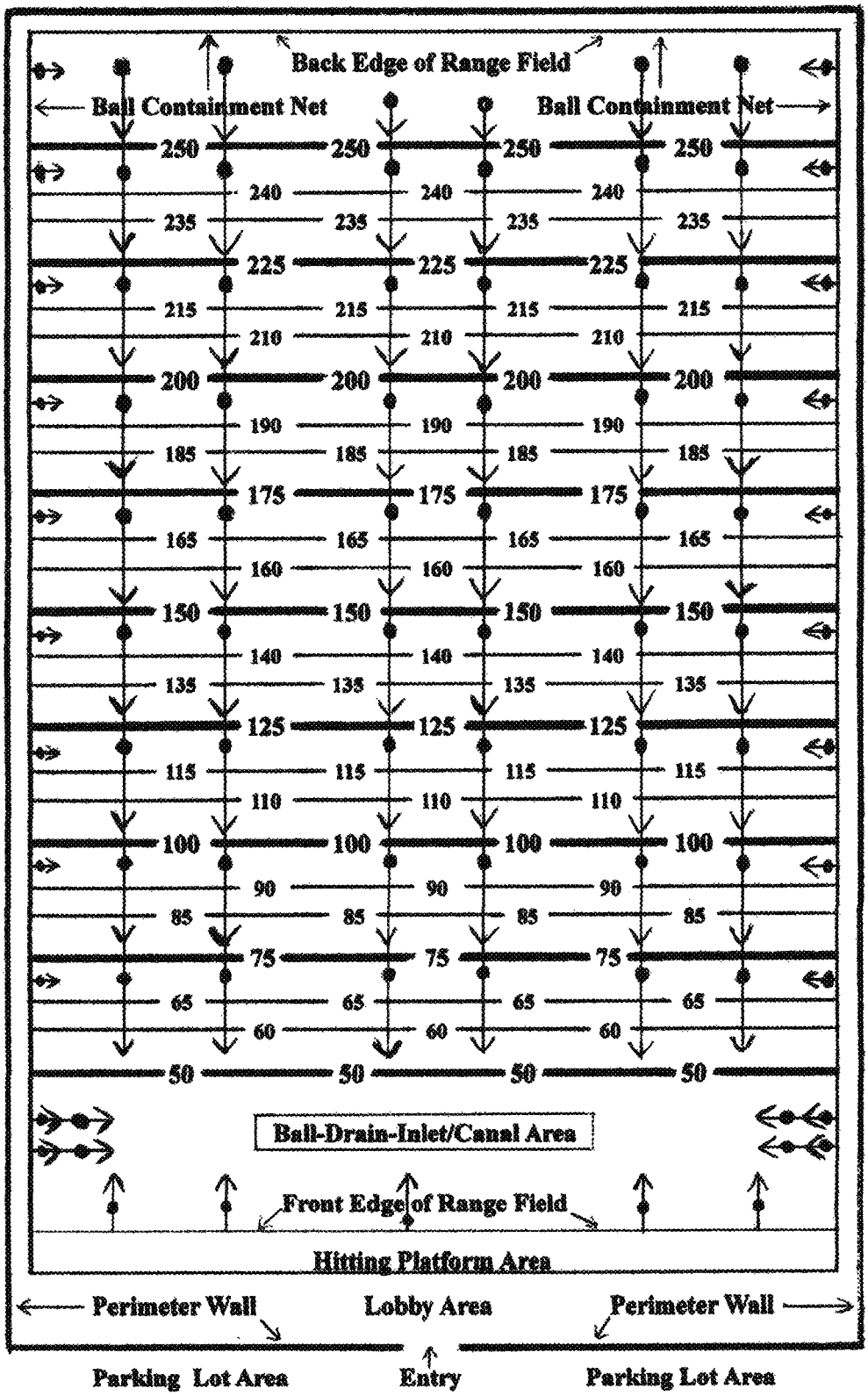
FIG. 9 shows a scale model of an embodiment of the present invention.
Figure 10:
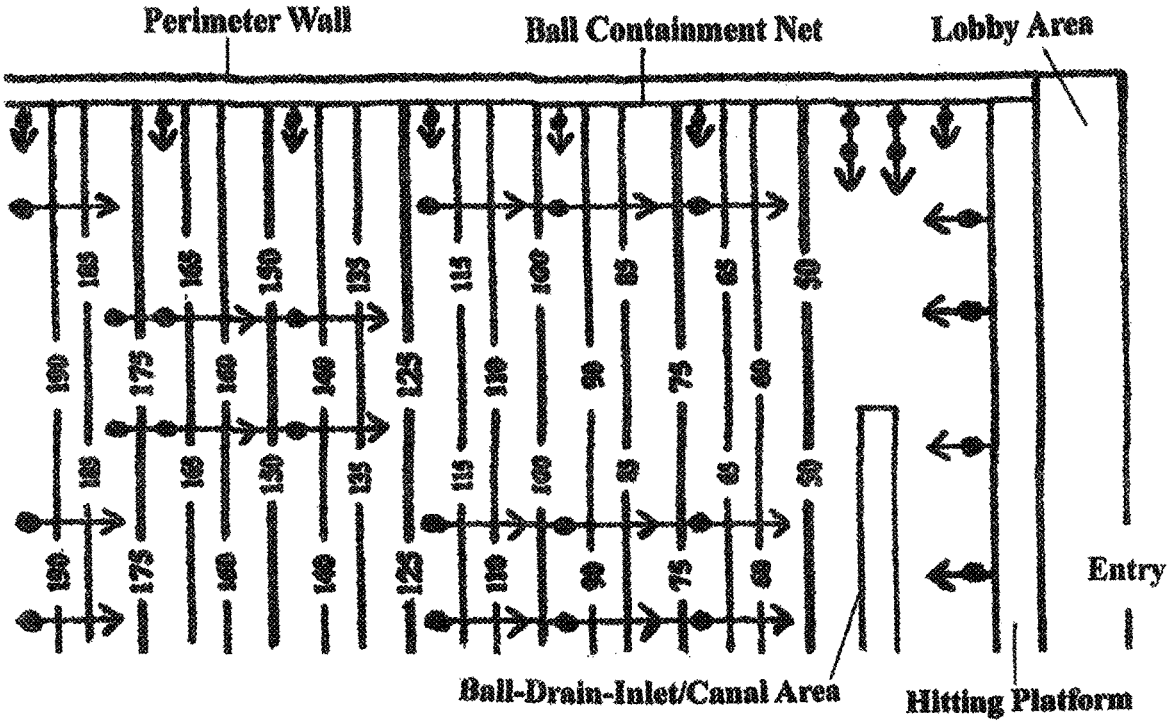
FIG. 10 shows a scale model of an embodiment of the present invention.
Figure 11:
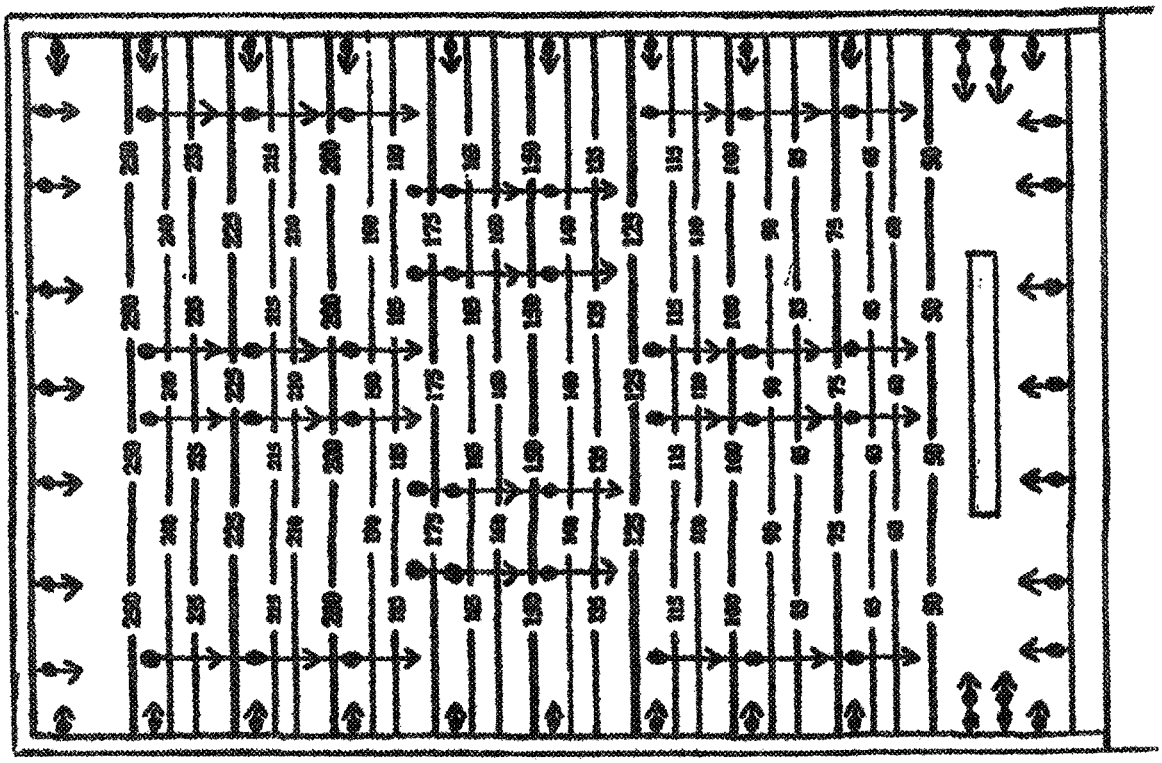
FIG. 11 shows a scale model of an embodiment of the present invention.
Figure 12:
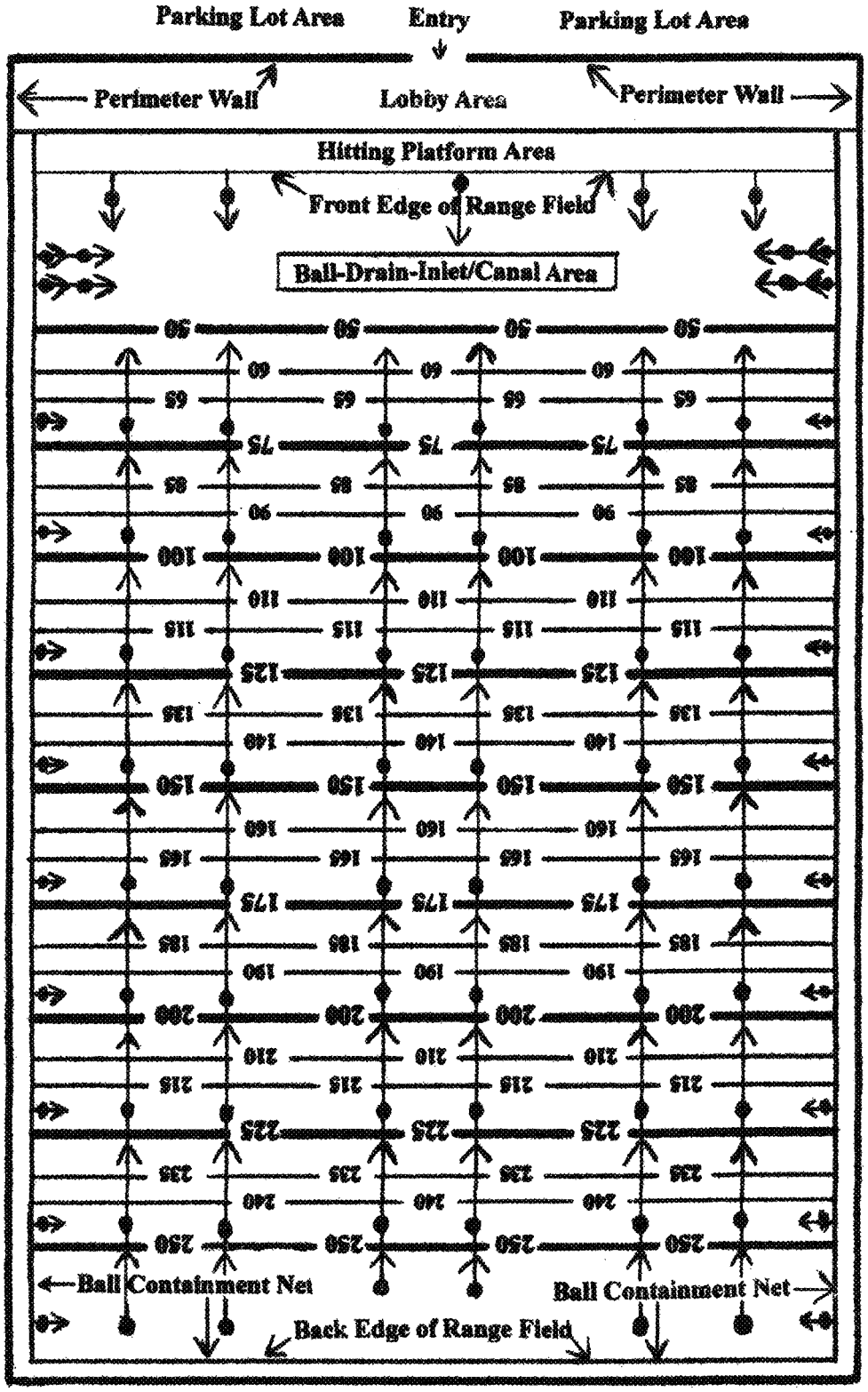
FIG. 12 shows a scale model of an embodiment of the present invention.
Figure 13:
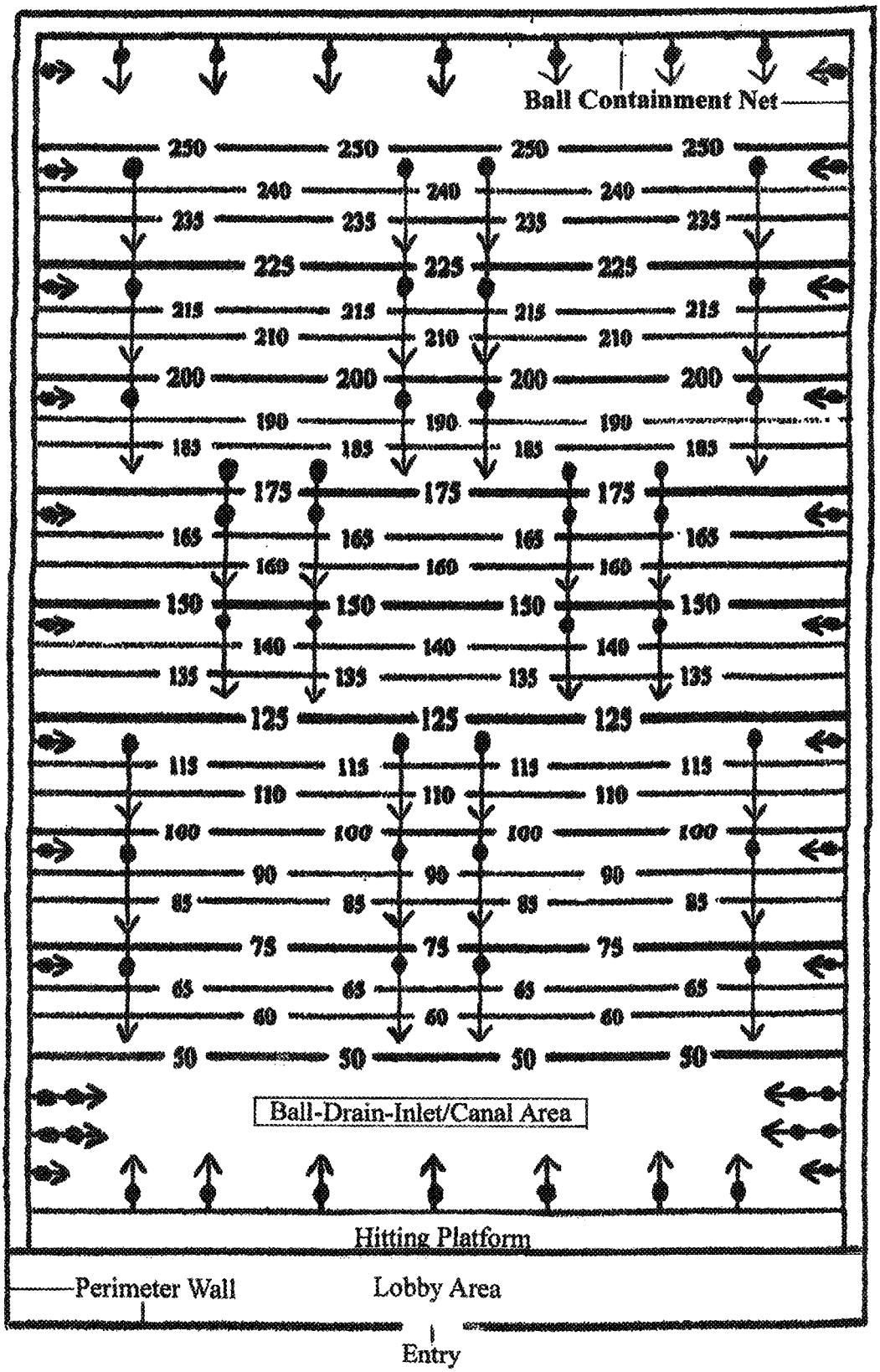
FIG. 13 shows a scale model of an embodiment of the present invention.
Figure 14:
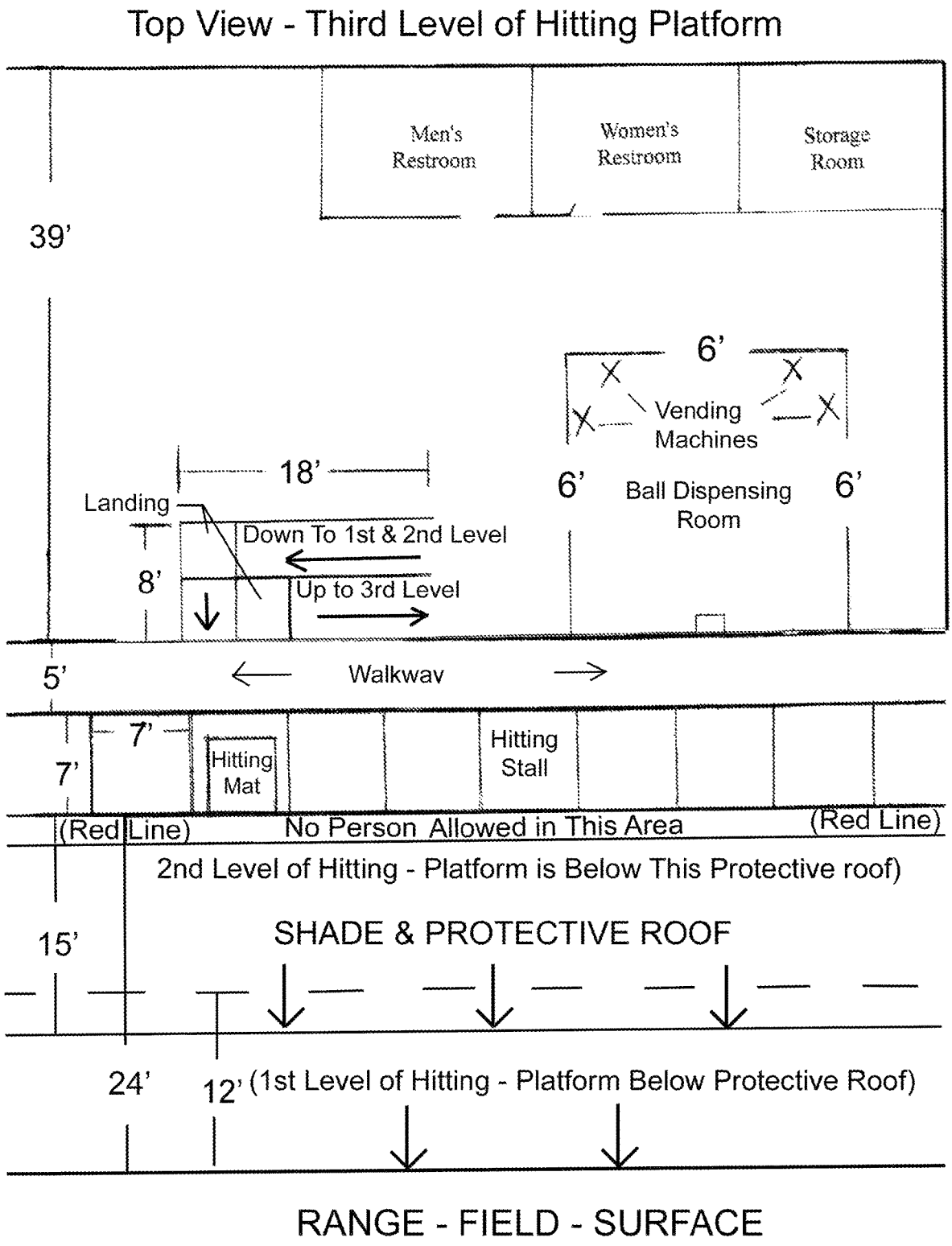
FIG. 14 shows an illustration of aspects of an embodiment of the present invention.
Figure 15:
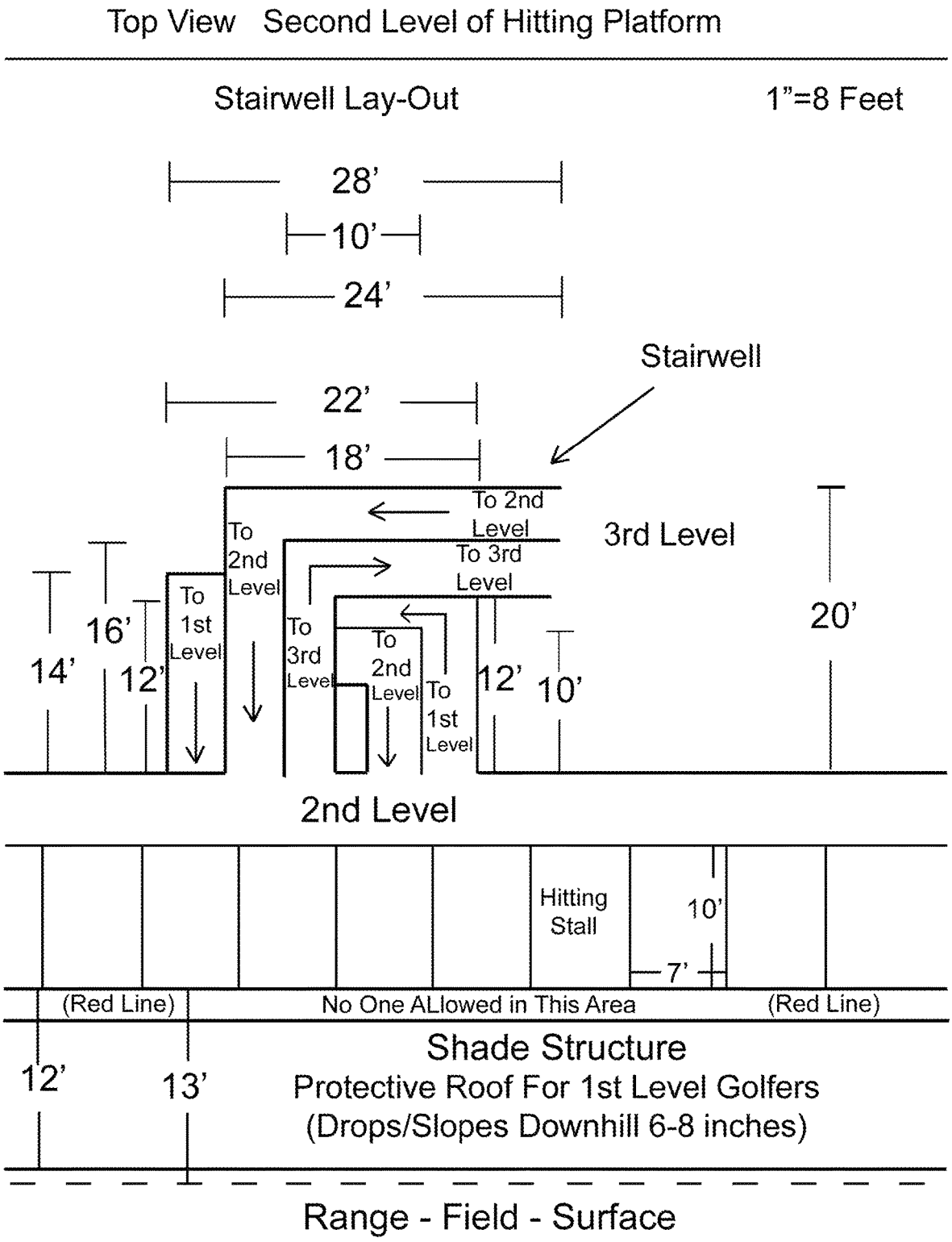
FIG. 15 shows an illustration of aspects of an embodiment of the present invention.
Figure 16:
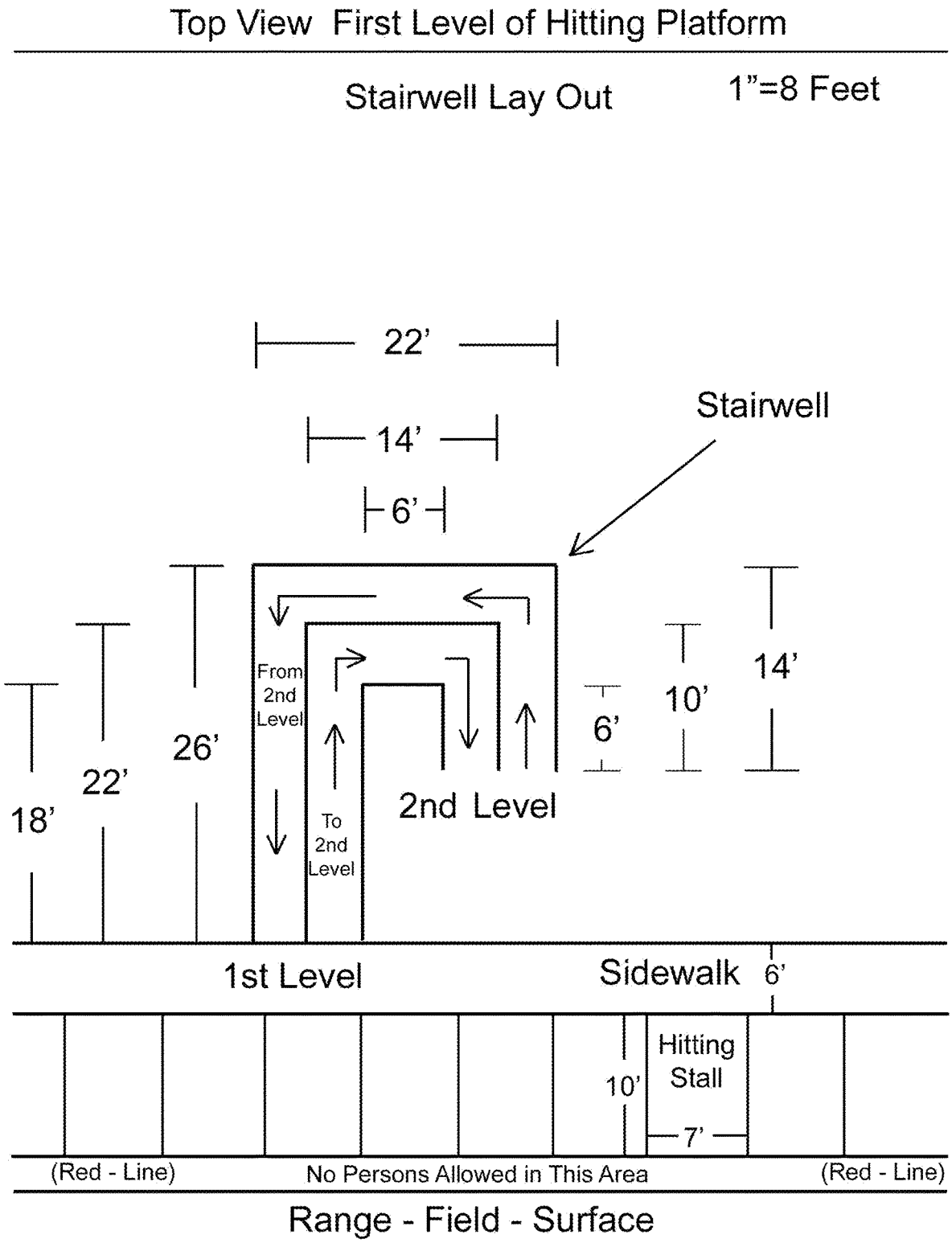
FIG. 16 shows an illustration of aspects of an embodiment of the present invention.
Figure 17:
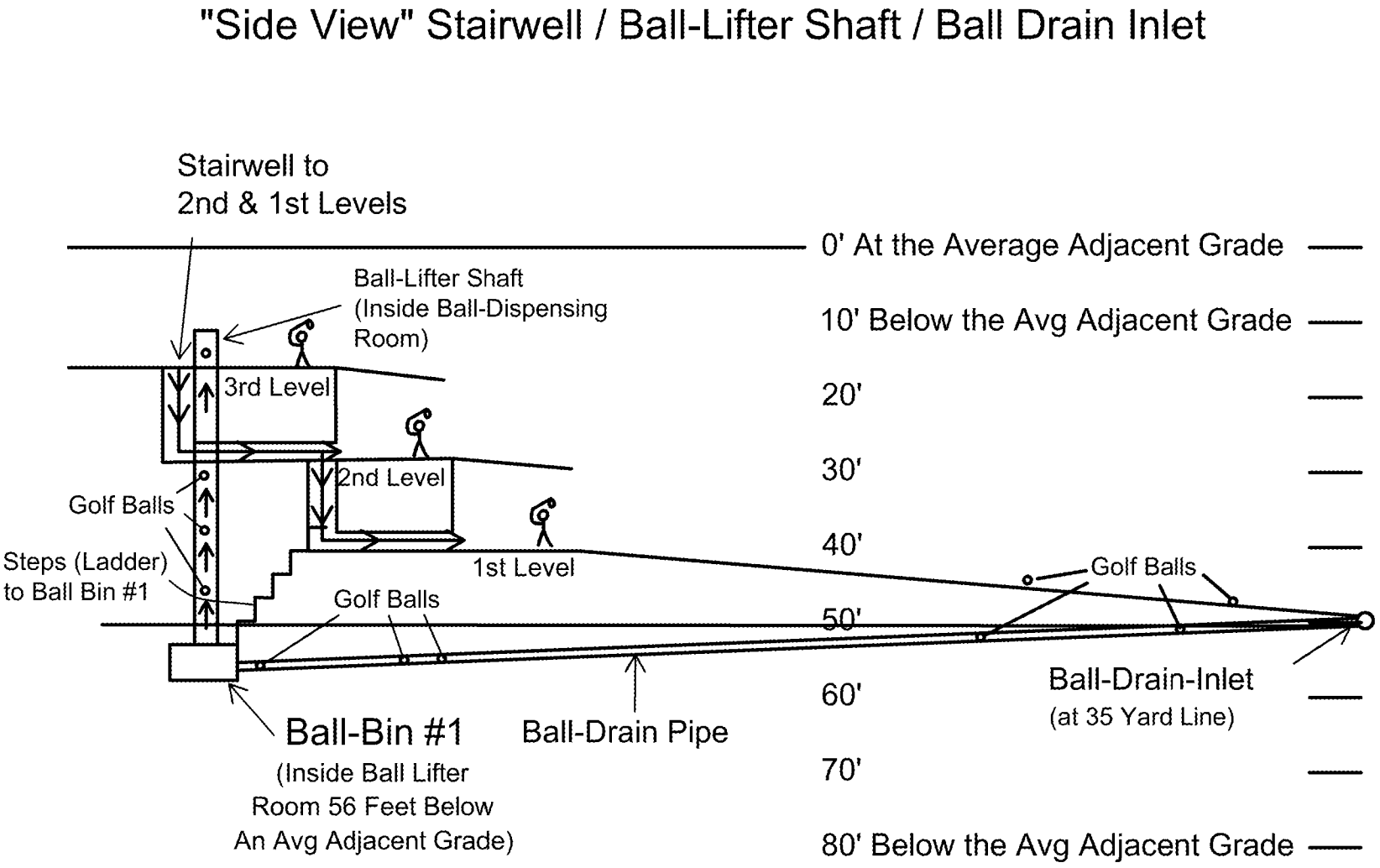
FIG. 17 shows an illustration of aspects of an embodiment of the present invention.
Figure 18:
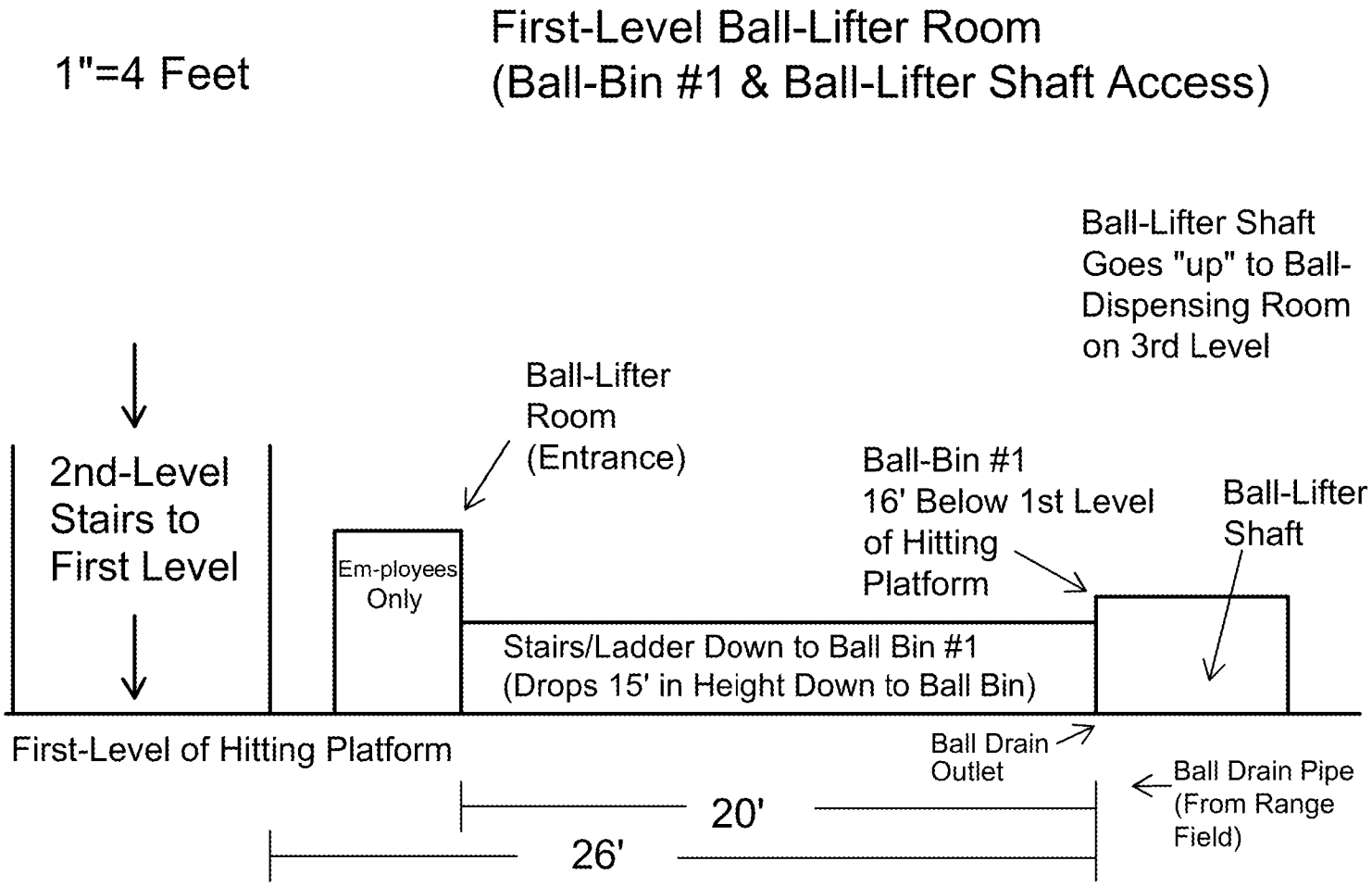
FIG. 18 shows an illustration of aspects of an embodiment of the present invention.
Figure 19:
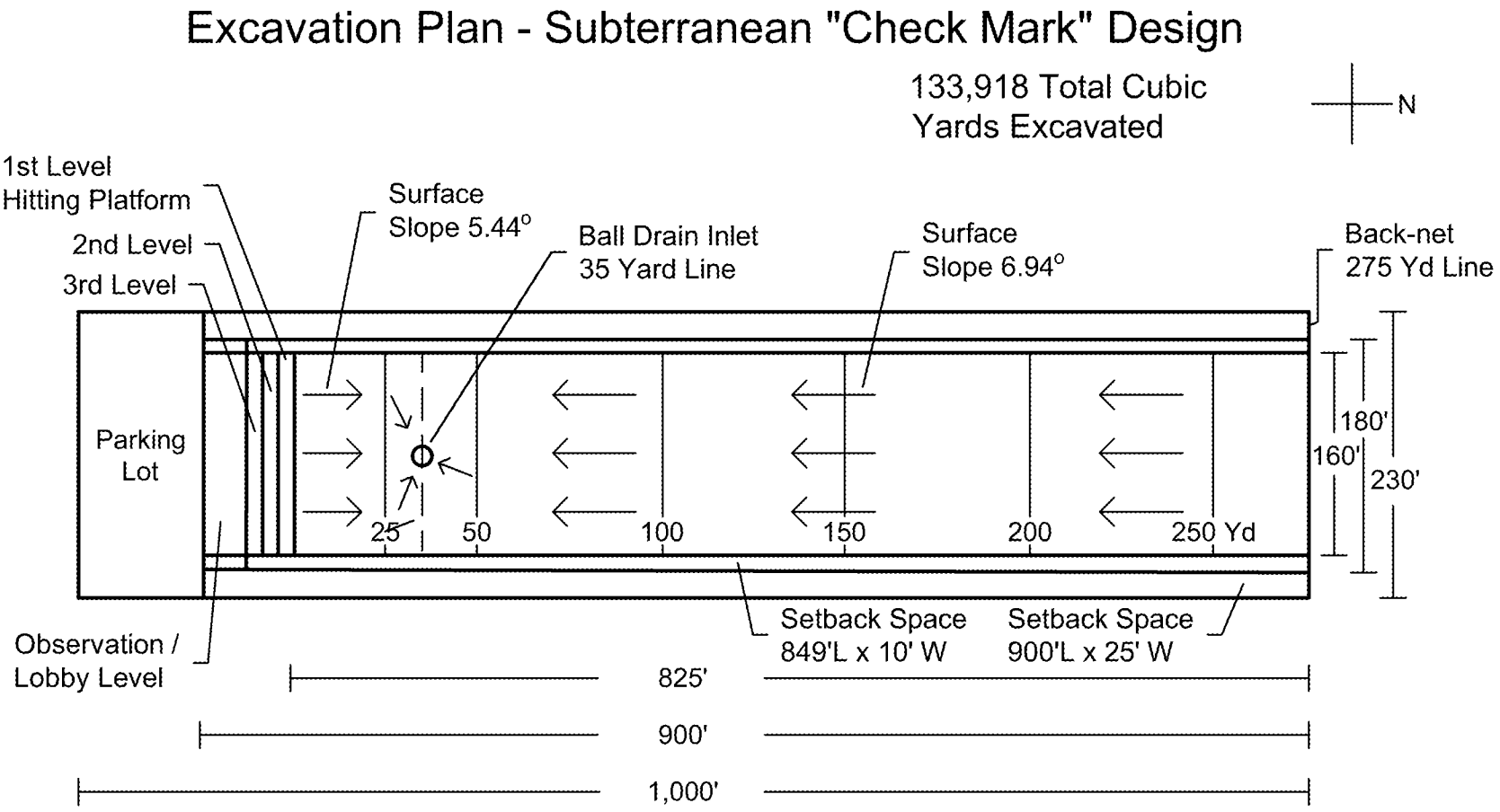
FIG. 19 shows an illustration of aspects of an embodiment of the present invention.
Figure 20:
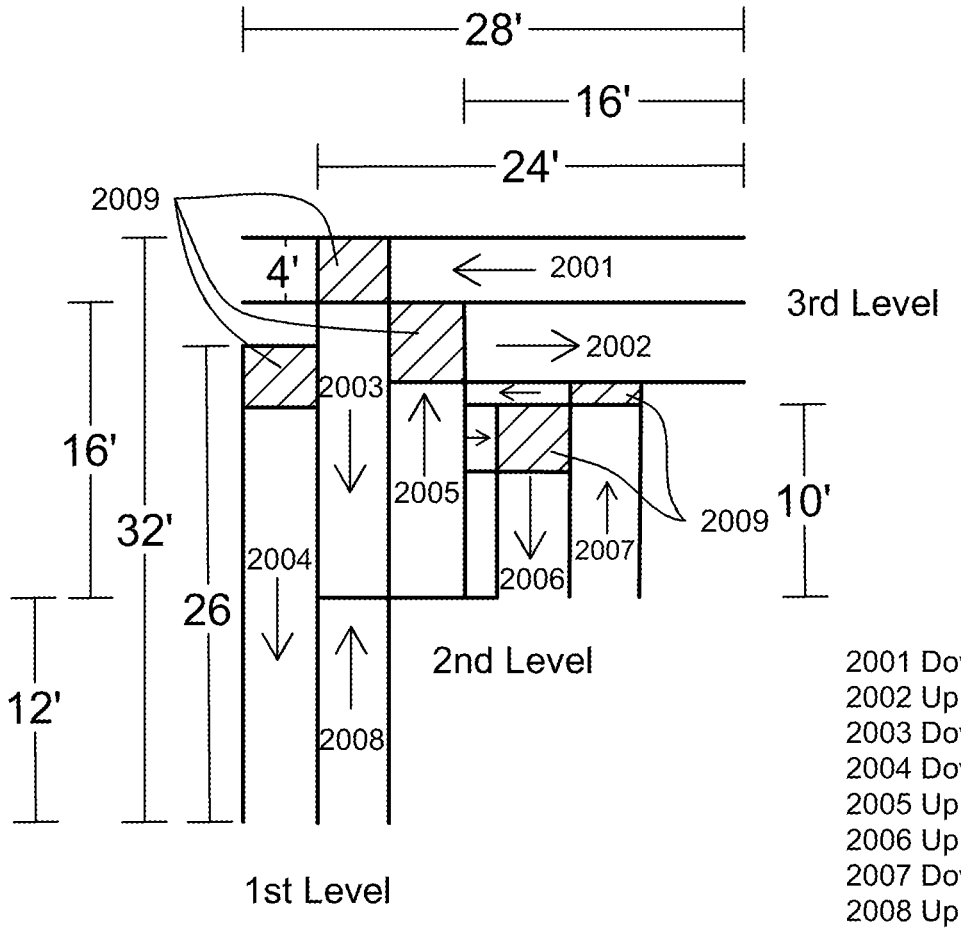
FIG. 20 shows an illustration of aspects of an embodiment of the present invention.
Figure 21:
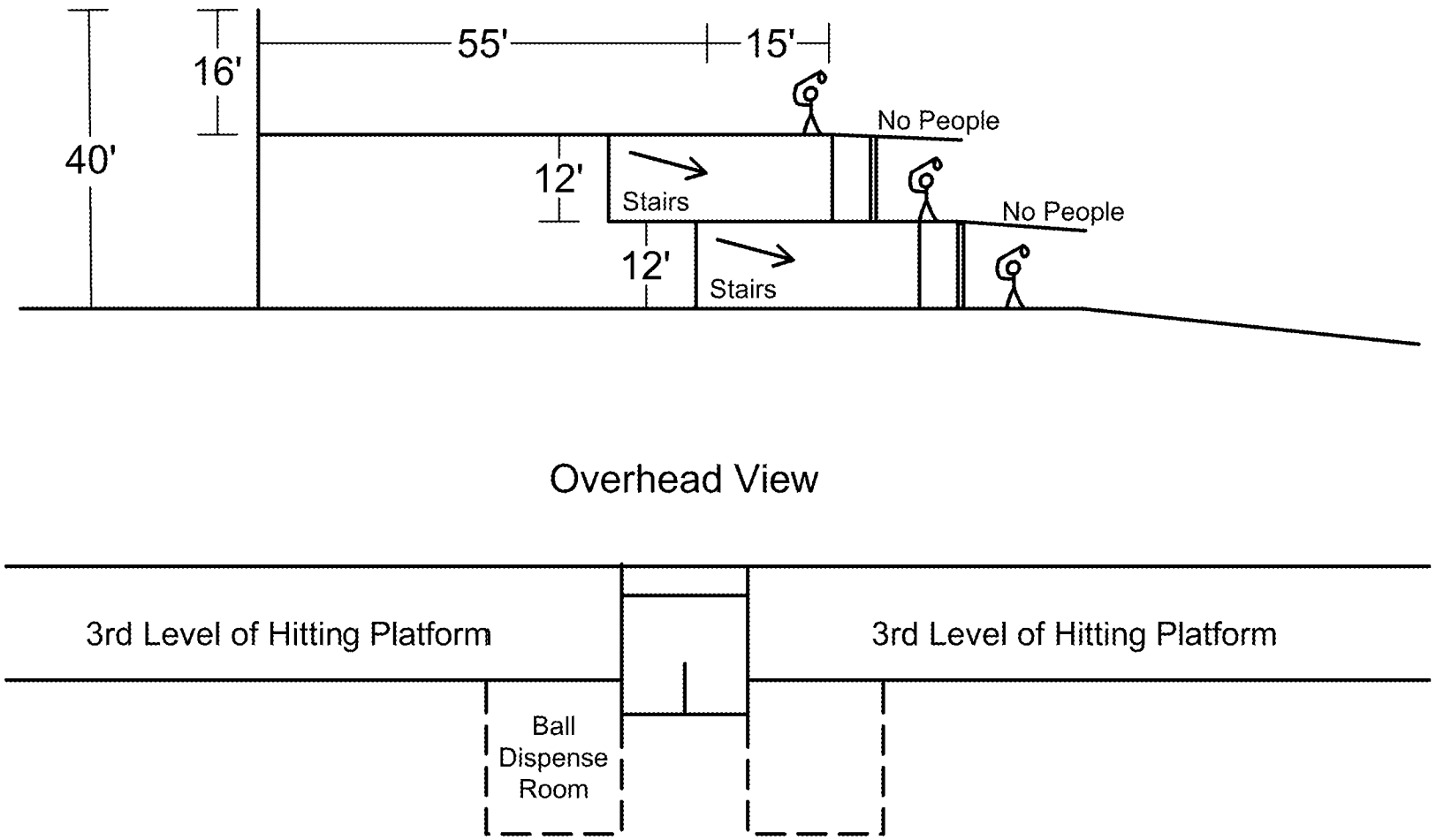
FIG. 21 shows an illustration of aspects of an embodiment of the present invention.
Figure 22:
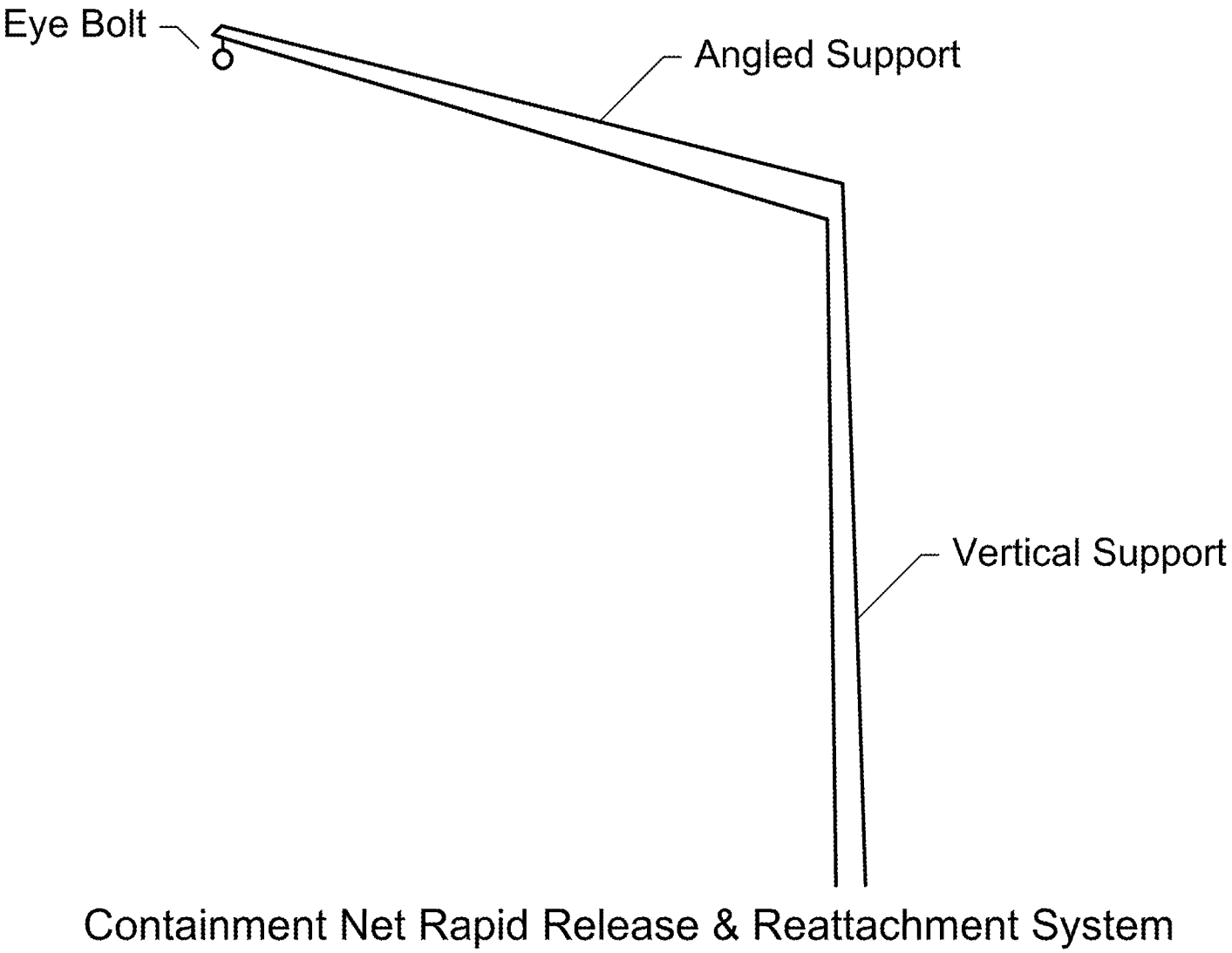
FIG. 22 shows an illustration of aspects of an embodiment of the present invention.
Figure 23:
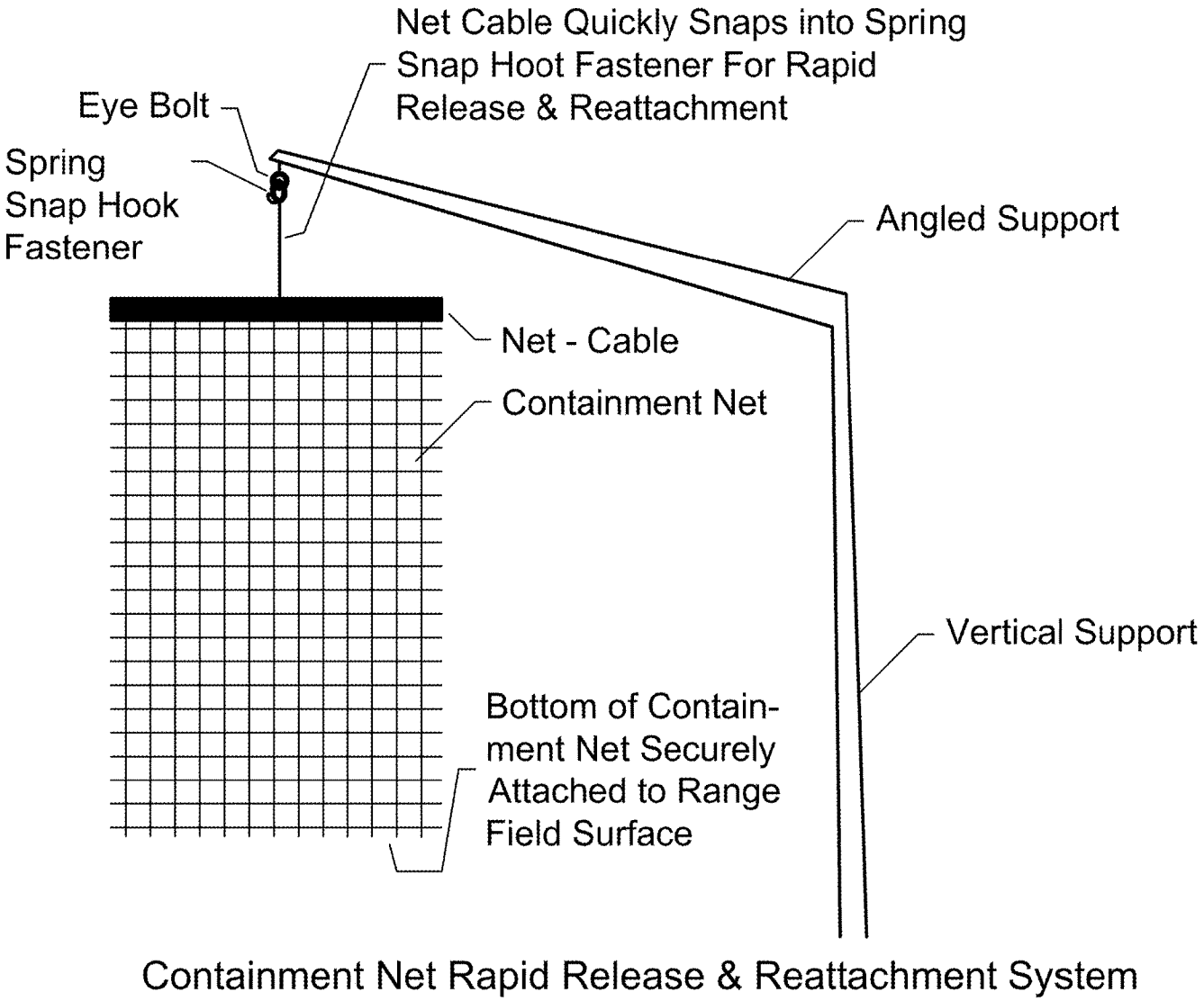
FIG. 23 shows an illustration of aspects of an embodiment of the present invention.
Figure 24:
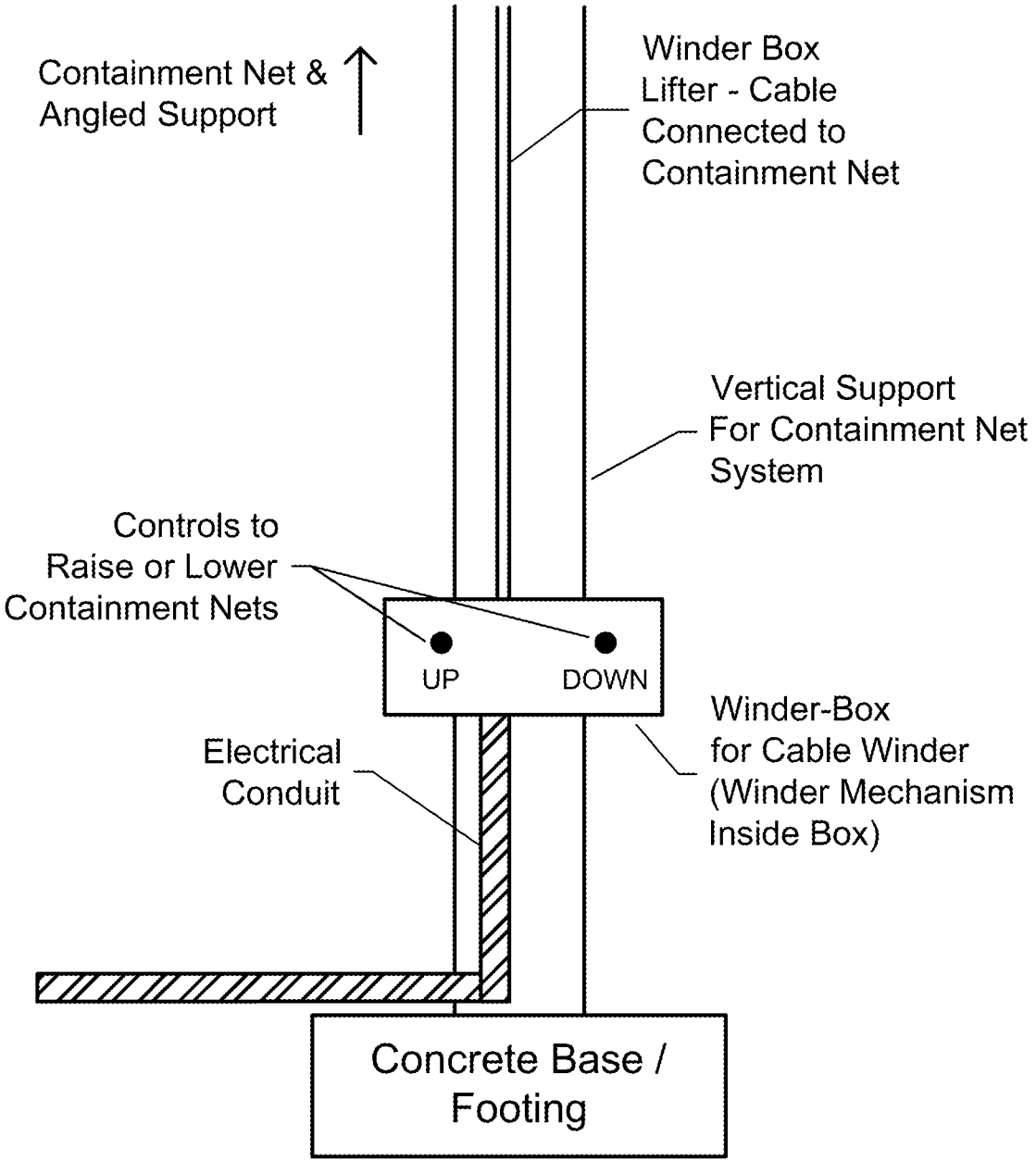
FIG. 24 shows an illustration of aspects of an embodiment of the present invention.
Figure 25:
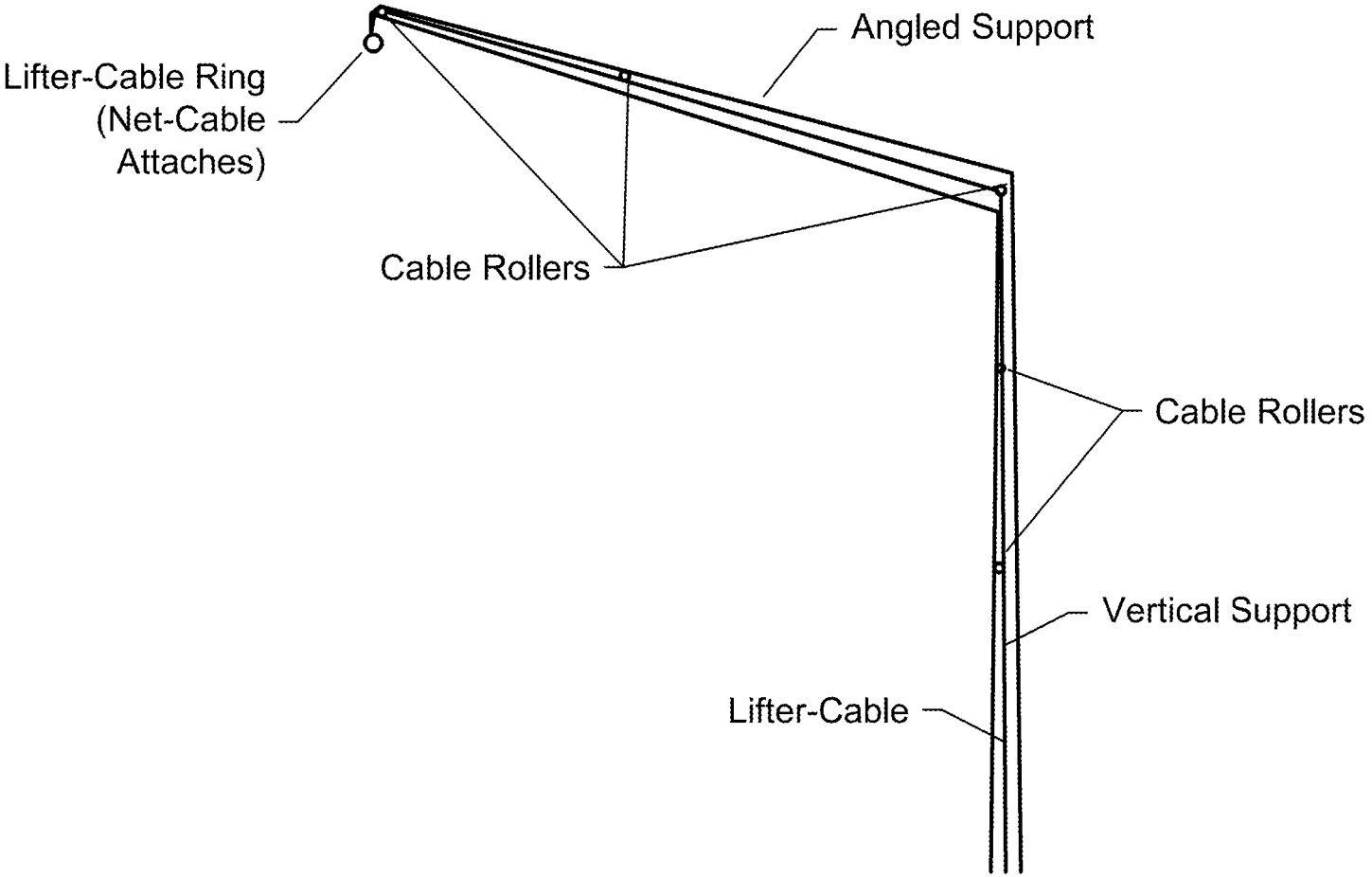
FIG. 25 shows an illustration of aspects of an embodiment of the present invention.
Figure 26:
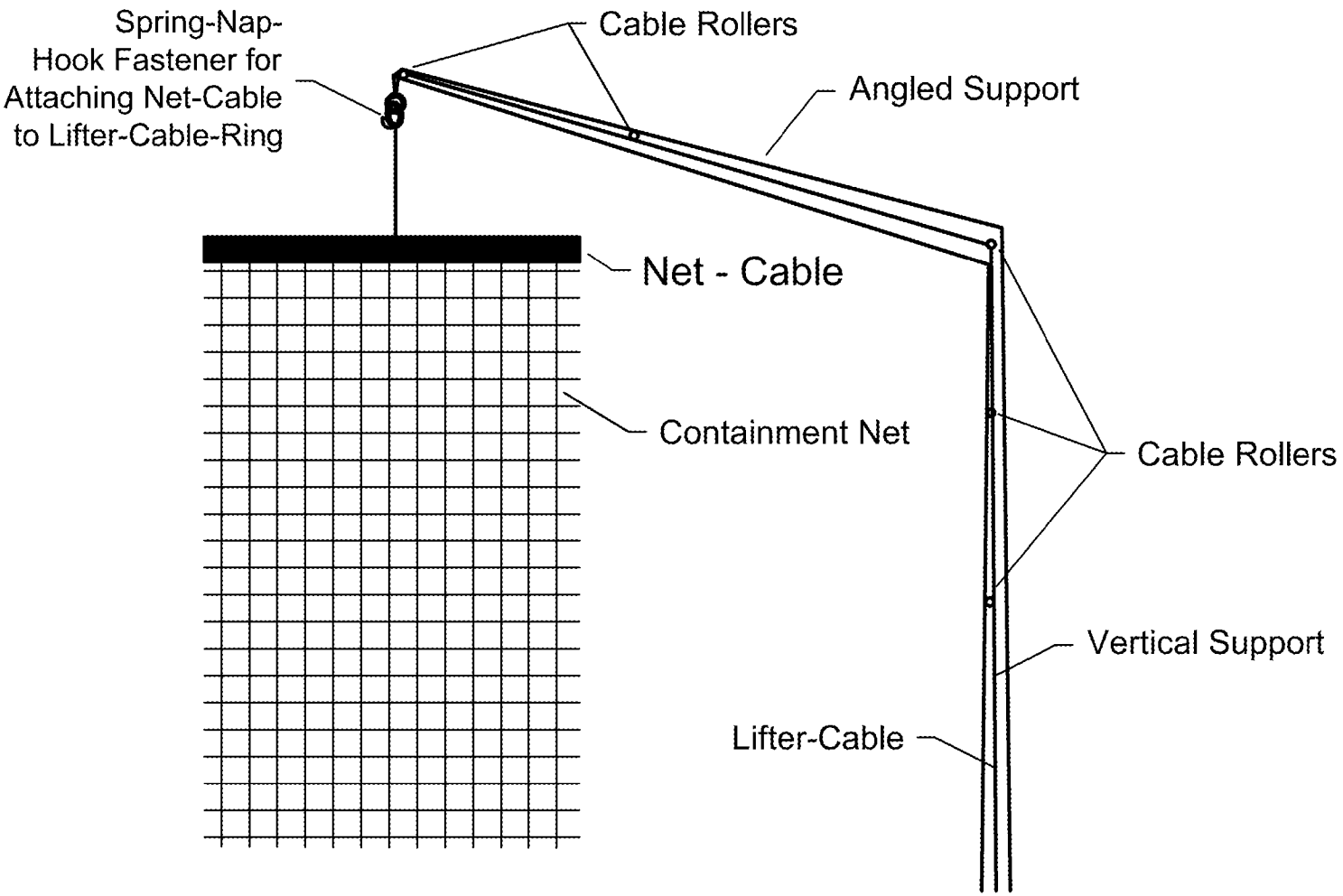
FIG. 26 shows an illustration of aspects of an embodiment of the present invention.
Figure 27:
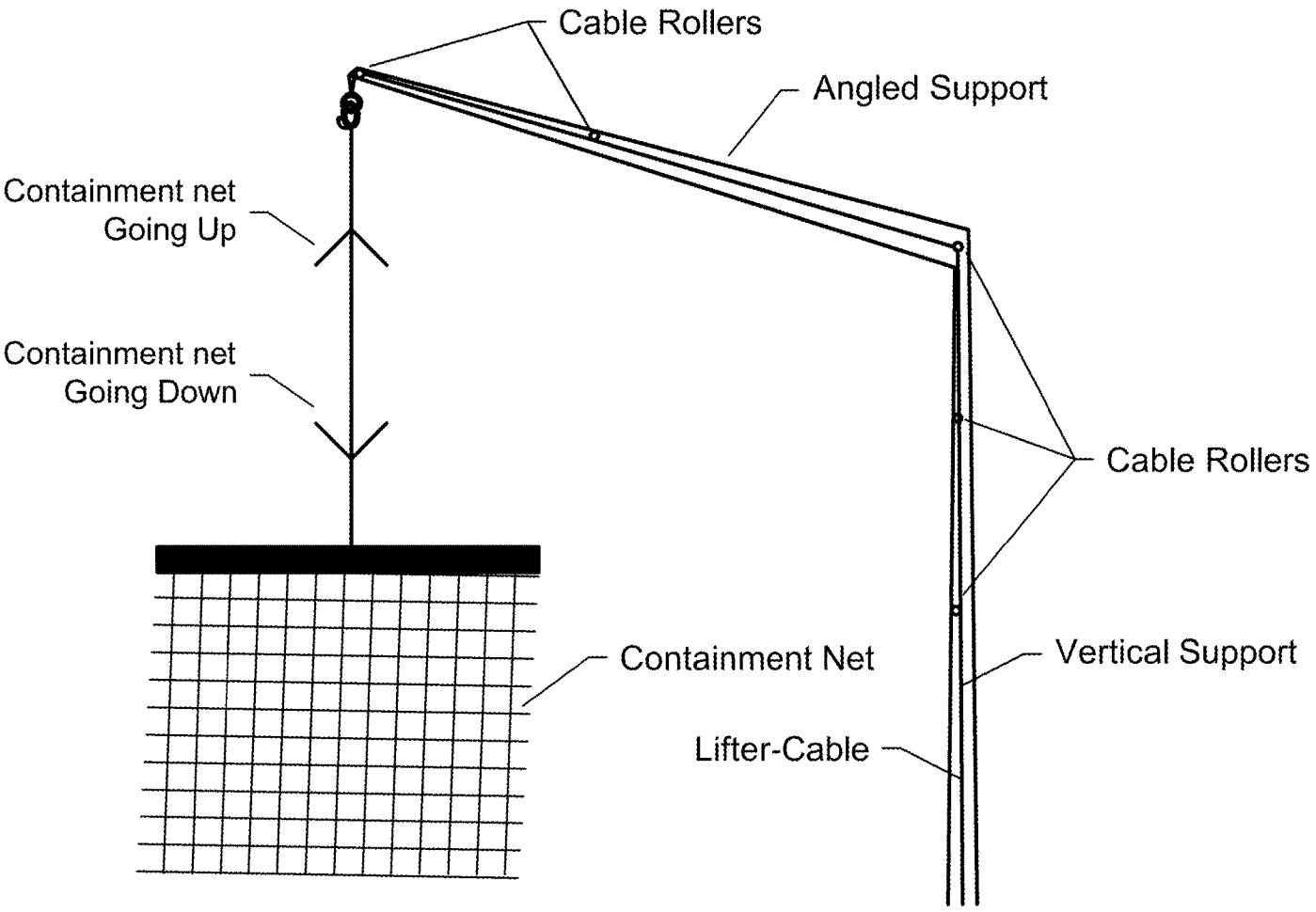
FIG. 27 shows an illustration of aspects of an embodiment of the present invention.
Figure 28:
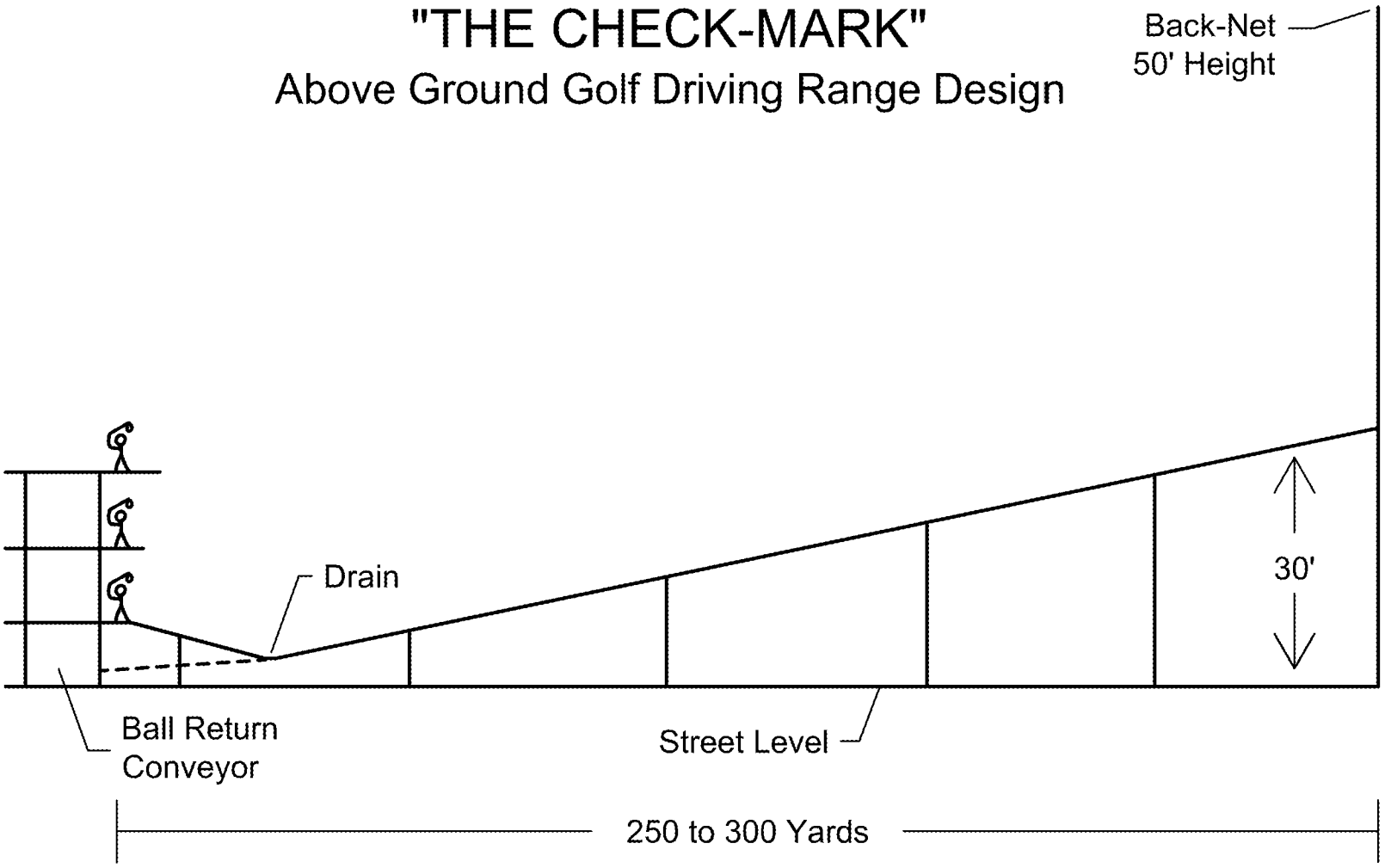
FIG. 28 shows an illustration of aspects of an embodiment of the present invention.
Figure 29:
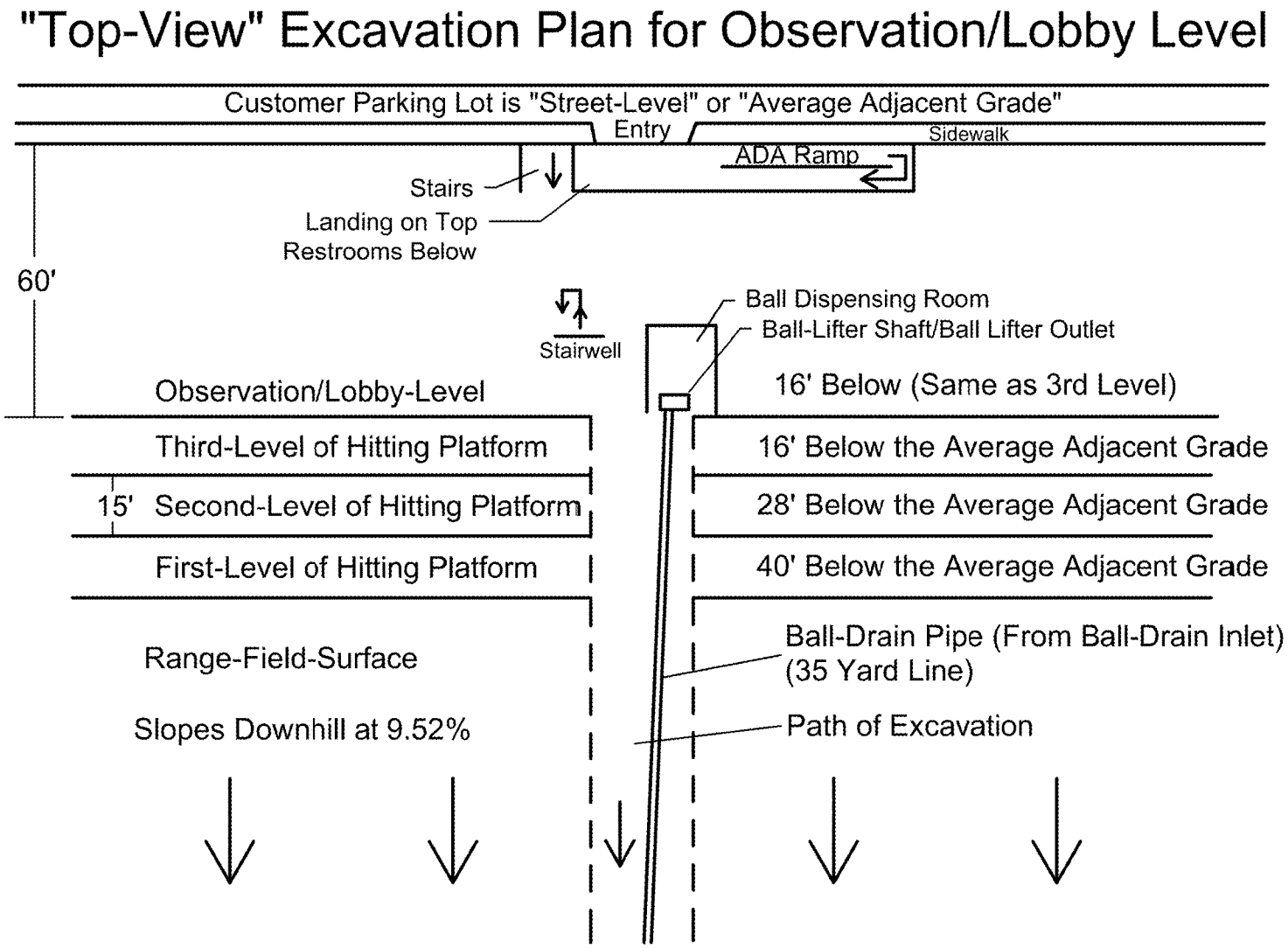
FIG. 29 shows an illustration of aspects of an embodiment of the present invention.
Figure 30:
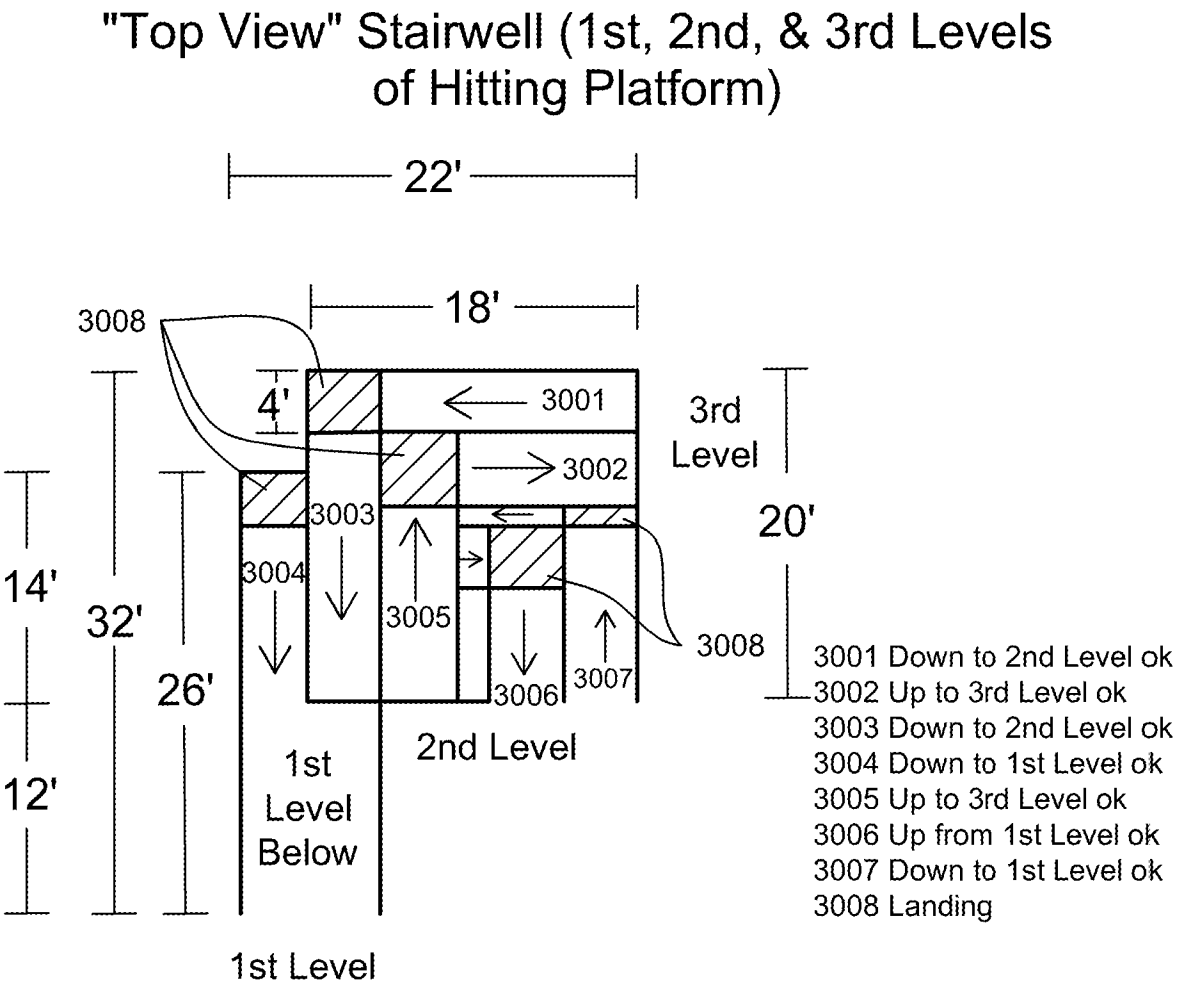
FIG. 30 shows an illustration of aspects of an embodiment of the present invention.
Figure 31:
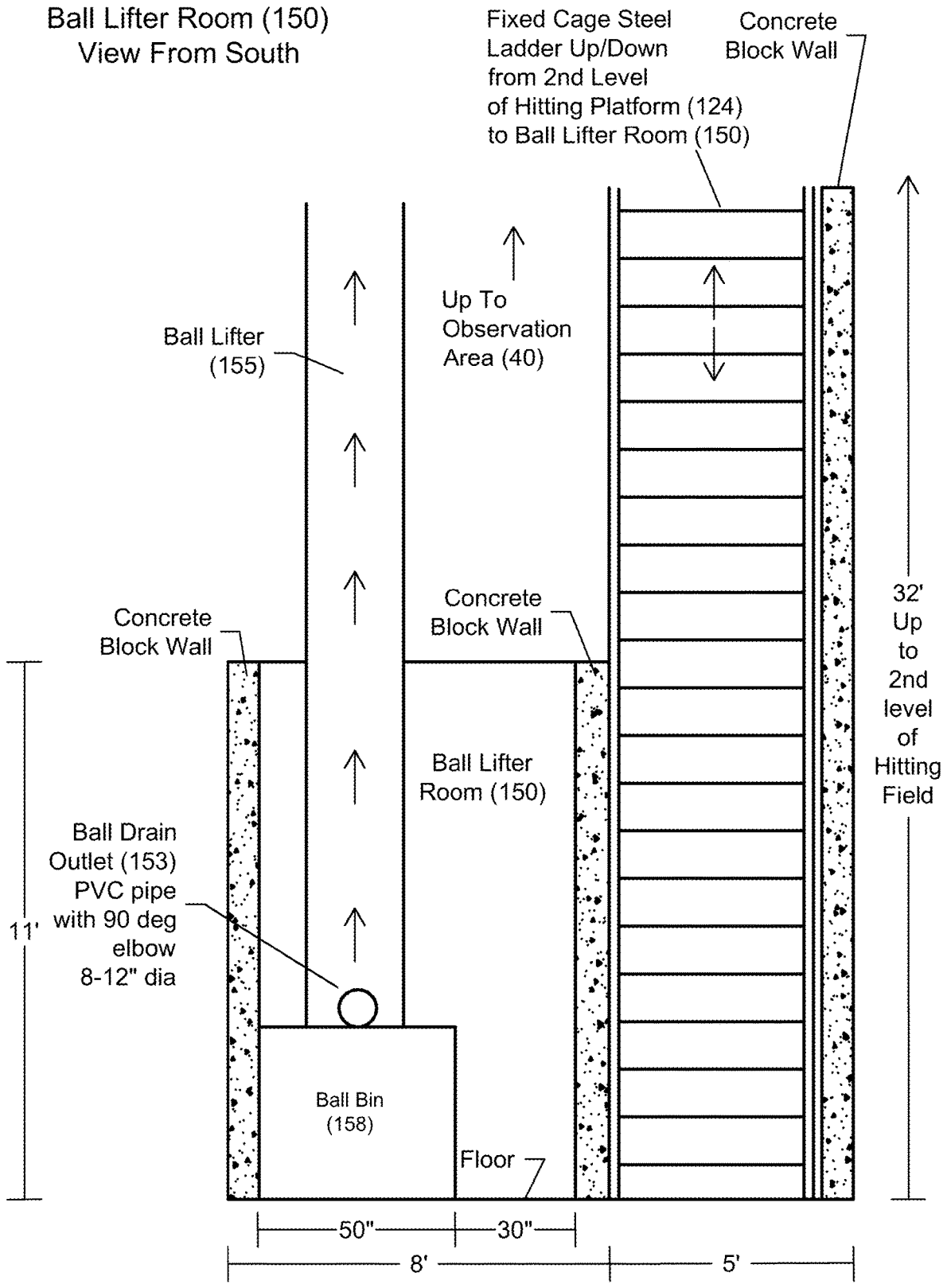
FIG. 31 shows an illustration of aspects of an embodiment of the present invention.

Following is a list of elements corresponding to a particular element referred to herein:

100 Driving range
101 Slope Indicator Arrow
102 Perimeter wall
104 Vertical support
105 Angled support
106 Containment net
108 Containment net cable
110 Range field surface
112 Front edge of range field surface (where hitting mats are located)
114 Back edge of range field surface (where back-net is located)
116 Side edge of range field surface (left-side and right-side)
118 Uphill range field surface (from hitting platform view)
119 Downhill range field surface (from hitting platform view)
120 Setback distance
122 Bottom/First level hitting platform
123 Bottom/First level hitting stalls
124 Second level hitting platform
125 Second level hitting stalls
126 Third level hitting platform
127 Third level hitting stalls
128 Fourth level hitting platform
129 Fourth level hitting stalls
130 Shade structure
131 Hitting mat
132 Hitting stall
133 Hitting stall safety wall
135 Solar panels
140 Observation area
150 Ball return system
152 Ball drain inlet
153 Ball drain outlet
155 Ball lifter
156 Ball station
160 Distance demarcations
162 Major distance demarcations
164 Minor distance demarcations
170 Camera system In some embodiment's, the present invention features above-ground, or subterranean (partially or fully) golf driving ranges (100). As a non-limiting example, the driving range (100) may include a range field surface (110) and a plurality of parallel hitting stalls (132) with at least some of the parallel hitting stalls (132) excavated a distance below or built/constructed above the average adjacent grade or a combination (semi-subterranean). This distance can be between 5 feet to 100 feet in height below or above the average adjacent grade. In some embodiment's, the back edge of a range field surface (114) may be level with the average adjacent grade. In selected embodiment's, the range field surface (110) may be disposed entirely below or above the average adjacent grade. In preferred embodiment's, the range field surface (110) may be excavated, graded, built, constructed, sloped, slanted, or tilted such that golf balls landing at any point on the range field surface (110) will automatically roll in a ball drain inlet (152). As a non-limiting example, golf balls hit onto a range-field-surface (110) may automatically be returned to a ball bin, ball station or other depository by a combination of gravitational effects or a ball return system (150) without the need to send workers, machines or ball-pick-up-equipment onto a range field surface (110) to get them.

The range field surface (110) may be surrounded by a perimeter wall (102). Without wishing to limit the present invention to any particular theory or mechanism, perimeter walls (102) may serve to shield both golfers and range field surfaces (110) from environmental factors such as sun, rain, wind, dust, and more. Furthermore, a perimeter wall (102) may act to safely prevent people and animals from gaining unauthorized access to the business property or from falling accidentally into a subterranean design driving range (100). Perimeter wall surfaces (102) may be transparent, partially opaque, totally opaque, and/or constructed from any suitable material. As non-limiting examples, perimeter wall (102) heights could be about 8, 10, 12, 15, 20, 25, 30, 40, 50, 60, 70, 80, 90 or 100 feet tall.

In some embodiment's, the range field surface (110) may be partially or fully surrounded by a containment net (106). A containment net (106) may be supported via a perimeter wall (102), vertical supports (104), angled supports (105) or other supports. In preferred embodiment's, a containment net (106) is suspended in such a way that golf balls hitting the containment net (106) cannot be damaged by hitting hard surfaces through the net. The golf driving range (100) may be partially or fully covered by a shade structure (130). A shade structure (130) may provide shade for some or all the hitting stalls (132), or an observation area (140), or for part or all of a range field surface (110), or any combination thereof. A shade structure (130) may comprise a plurality of solar panels (135) that may be partially or fully retractable, and may be partially or fully waterproof. According to some embodiment's, the observation area (140) may be about 5 to 30 feet below, or above an average adjacent grade, with stairs, non-slip ramps, or an elevator allowing golfers and others to ascend or descend from an entry area to the observation area (140), and to ascend or descend from the observation area (140) to any hitting stall (132) on the various levels of a hitting platform. In some embodiment's, a 4 foot high safety wall may separate the observation area (140) from the hitting stalls (132) at the same elevation.

According to some embodiment's, the plurality of parallel hitting stalls (132) may comprise a plurality of bottom/first level hitting stalls (123) disposed on bottom/first level hitting platform (122), and a plurality of second level hitting stalls (125) disposed on a second level hitting platform (124). As a non-limiting example, a second level hitting platform (124) may be positioned about 8-30 feet above a bottom/first level hitting platform (122). Similarly, the driving range (100) may include three, four or more stacked hitting platform levels, each with a row of parallel hitting stalls (132). As a non-limiting example, a plurality of hitting stalls (132) may be disposed across a bottom/first level hitting platform (122), a second level hitting platform (124), a third level hitting platform (126), a fourth level hitting platform (128), or more, with each subsequent hitting platform level disposed about 8-30 feet in height above the previous hitting-platform level, and setback 8-30 feet in distance from the previous hitting-platform level. According to selected embodiment's, the bottom/first level hitting platform (122) may be at or about the elevation of the front edge of a range field surface (112). This may provide additional safety for golfers on this platform level as any fall from the bottom/first level hitting platform (122) to the range field surface (110) would be small enough to minimize the possibility of injury.

In some embodiment's, the range field surface (110) may comprise soft, rubbery, recyclable, non-grass (no natural, synthetic or artificial grass) materials that don't use water or harm golf balls. The driving range (100) may comprise a ball return system (150) configured to automatically return golf balls to a ball-bin, ball station (156), or other depository. As a non-limiting example, a depository may be a holding bin configured to feed a plurality of ball-dispensing-machines. In some embodiment's, the driving range (100) may comprise a camera system (170) configured to visually track a plurality of golf balls hit from the hitting stalls (132) and calculate a carry distance for each of the plurality of golf balls. The camera system (170) may use a single camera, or a plurality of cameras for various purposes. As a non-limiting example, the camera system (170) may include a single camera, or plurality of cameras disposed on hitting platforms levels, above hitting platforms, around the observation area (140), range field surface (110), parking-lot, entry area, perimeter wall (102), or any combination thereof.

In some embodiment's, the present invention features intentionally sloped, slanted, or tilted range field surfaces (110) with verified distance demarcations (160). In some embodiment's, distance demarcations may comprise white, black, or colored stripes about 2-18 inches in width disposed across the range field surface (110) horizontally so they're parallel with a "yardage measurement line" marked on the bottom/first level hitting platform (122) near the front edge of the range field surface (112). In selected embodiment's, some or all the distance demarcations (160) may be illuminated with white or colored lights in low-light conditions, for example via an embedded light-strip, or plurality of overhead lights. As a non-limiting example, the golf driving range (100) may comprise a sloped, slanted, or tilted range field surface (110) having a plurality of distance demarcations (160) with each disposed parallel to a "yardage measurement line" marked on the bottom/first level hitting platform (122) near the front-edge of a range field surface (112), with each distance demarcation (160) corresponding to a numbered yardage; a bottom/first level hitting platform (122) having a plurality of bottom/first level hitting stalls (123) positioned parallel with the front edge of a range-field-surface (112); a second level hitting platform (124) having a plurality of second level hitting-stalls (125) positioned above the bottom/first level hitting-stalls (123), and set back from the bottom/first level hitting stalls (123) by a setback distance (120) such that an equivalent carry distance from each bottom/first level hitting stall (123) to any distance demarcation (160) is about the same or equal to the equivalent carry distance from each second level hitting-stall (125) to that same distance demarcation (160). As used herein, the term "equivalent carry distance" refers to a corrected distance calculation which accounts for elevation differences between the two points so as to represent the corresponding distance a golf ball traveling the distance would have carried on level ground. In some embodiment's, the calculation of "equivalent carry distance" may require assumptions regarding trajectory, angle, and ball velocity used to calculate equivalent carry distances. Accordingly, average values of trajectory, angle and ball velocity may be used to calculate equivalent carry distances, but the standard "rule of thumb" calculation for elevation to yardage difference is: for every 1 foot of elevation difference there is 1 foot of yardage difference. As a non-limiting example, if the second level hitting platform (124) is 12 feet in elevation above the bottom/first level hitting-platform (122), the "yardage measurement line" on the second level hitting-platform (124) needs to be set back 12 feet in distance further away from the "yardage measurement line" on the bottom/first level hitting platform (122) near the front edge of the range-field-surface (112) so the distance demarcations (160) on the range field surface (110) are equal or about the same for both hitting platform levels. Alternatively, a camera system may also measure trajectory, angle, and ball velocity to calculate an extremely precise equivalent for the carry distance of a ball hit with a golf club.

The distance demarcations (160) may comprise both major distance demarcations (162), and minor distance demarcations (164). Each of the distance demarcations may be white, black, or colored. In some embodiment's, the major distance demarcations (162) may be colored with different colors and minor distance demarcations (164) may be white or black. As a non-limiting example, major distance demarcations (162) may be disposed at the 25, 50, 75, 100, 125, 150, 175, 200, 225, 250, 275, and 300 yard distances, and minor distance demarcations (164) may be disposed at the 35, 40, 60, 65, 85, 90, 110, 115, 135, 140, 160, 165, 185, 190, 210, 215, 235, and 240 yard distances. As another non-limiting example, distance demarcations (160) may include colored major distance demarcations (162) disposed at the 25, 50, 75, 100, 125, 150, 175, 200, 225, 250, 275, and 300 yard distances, a first set of minor distance demarcations (164) marked in black and disposed at the 30, 45, 55, 70, 80, 95, 105, 120, 130, 145, 155, 170, 180, 195, 205, 220, 230, and 245 yard distances, with a second set of minor distance demarcations (164) marked in white at the 35, 40, 60, 65, 85, 90, 110, 115, 135, 140, 160, 165, 185, 190, 210, 215, 235, and 240 yard distances. In preferred embodiment's, the slope, slant, or tilt of range field surfaces (110) may be at a sufficiently steep angle to roll golf balls down towards a ball drain inlet (152). As non-limiting examples, the slope, slant, or tilt of the range field surface (110) may be greater than about 1, 1.5, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, 20, 21, 22, 23, 24, 25, 26, or 27 degrees or more. In some embodiment's, a ball drain inlet (152), canal, or depository may be located underneath the bottom/first level hitting platform (122), or run parallel with the front edge of a range field surface (112), about 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, or more feet from the front edge of a range field surface (112).

In some embodiment's, the present invention features systems for containing golf balls within a driving range (100). As a non-limiting example, the system(s) may comprise: a range-field-surface (110); a plurality of vertical supports (104) each positioned a distance away from an edge of the range field surface (110); and a containment-net(s) (106), suspended to hang from the angled supports (105) such that the net (106) hangs freely without touching any hard surface between its top and bottom edge. In some embodiment's, the bottom edge of the net (106) may be fixed to the range field surface (110). The net(s) (106) may be hung from the angled supports (105) via one or more containment net cables (108) running along a top edge of the net (106). In some embodiment's, one or more containment net cables (108) may allow for all or a portion of the containment net (106) to be partially or fully lowered for installation, maintenance, repair, or replacement by decreasing the tension of the cable (108) either manually or automatically via an electronic control device. After installation, maintenance, repair, or replacement is completed, tension on the cable (108) may be restored either manually or automatically via an electronic control device so as to return the net (106) back into proper positioning.

In some embodiment's, the present invention may feature a range field surface (110) with color-coded distance demarcations (160). As a non-limiting example, the golf driving range (100) may comprise: a range field surface (110); a plurality of major distance demarcations (162) disposed across the range field surface (110) horizontally, each colored with a different color; and a plurality of minor distance demarcations (164) disposed across the range field surface (110) horizontally, each colored with a neutral color (black or white). According to preferred embodiment's, each distance demarcation (160) corresponds equally to an equivalent carry distance from the bottom/first level hitting platform (122), and the same equivalent carry distance from a second level hitting-platform (124) above, and set back a correct distance away from the bottom/first level hitting-platform (122) so the carry distance for a golf ball would be equal or about the same from either level of the hitting platform.

In one or more embodiment's, the present invention features an above-ground, subterranean or partially subterranean golf driving range (100). As a non-limiting example, the driving range (100) may comprise: a substantially rectangular range field surface (110); a plurality of parallel hitting stalls (132) positioned along the front edge of a range-field-surface (112), at least some of the hitting stalls (132) excavated a distance below or constructed a distance above an average adjacent grade surrounding the driving range (100) or a combination thereof (semi-subterranean); a ball drain inlet (152), canal or depository located underneath the bottom/first level hitting-platform (122), or bisecting the range field surface (110) into a downhill range field surface (119) and/or an uphill range field surface (118); with a ball drain inlet (152) bisecting the range field surface (110), or a canal parallel to a front edge of the range field surface (112) and sloping towards the middle of the range field surface (110), with a ball return system (150) connected to the ball drain inlet (152), or canal connected to a ball drain pipe (154) connected to a ball drain outlet (153) that's connected or goes to a ball station (156), ball-bin, or other depository disposed on an observation area (140), or any hitting platform level, the ball return system (150) configured to lift balls via a ball-lifter (155) to a ball station (156), ball-bin, or other depository. In some embodiment's, the downhill range-field-surface (119) may slope from the front-edge of the range-field-surface (112) down towards a ball drain-inlet (152), or canal such that golf balls landing on the downhill range field surface (119) automatically roll downhill into a ball drain inlet (152), or canal. Similarly, the uphill-range-field-surface (118) may slope from the back edge of a range field surface (114) down towards the ball drain inlet (152), a canal, or go underneath the bottom/first level hitting platform (122) such that balls landing on the uphill-range-field-surface (118) automatically roll down into the ball drain inlet (152), or a canal, or go underneath the bottom/first level hitting platform (122). In preferred embodiment's, each hitting stall (132) comprises a golf hitting-mat (131). The hitting mat (131) may be a square mat (131), and may be configured to be regularly rotated. In some preferred embodiment's, the uphill range field-surface (118), and/or downhill range field surface (119) may have a degree of slope of about 1% or greater than 27%.

Golf driving ranges (100) of the present invention may be constructed in a variety of sizes and configurations in order to accommodate various numbers of golfers in various available property sizes. Each hitting stall (132) may have a width of about 7-12 feet, and may be separated from each other by a plurality of hitting stall safety walls (133). As such, approximately 30-50 hitting stalls (132) may be arranged on a 210-600 foot long (distance) hitting platform, and approximately 7-30 hitting stalls (132) may be arranged on a 50-360 foot long (distance) hitting-platform. While a golf driving range (100) with a single hitting platform may accommodate 60 hitting stalls with a 720 foot long (distance) hitting platform, smaller golf driving ranges (100) may accommodate the same number of golfers in a quarter of the total footprint area by using a hitting platform with multiple levels.

By using a setback system to stagger each subsequent level of a hitting platform with multiple levels farther back from a front edge of a range field surface (112) the same distance demarcations will accurately represent equivalent carry distances from each level of the same multi-level hitting platform. Alternatively, if some levels of a hitting platform are the same distance from the front edge of a range field surface (112), each level of the multi-level hitting-platform will have different carry distances so a guide, mapping each of the distance demarcations to a different distance for each hitting platform level can be used so golfers can calculate the correct carry distance for that hitting-platform level. As a non-limiting example, the 100 yard distance demarcation for the bottom/first level of a hitting platform with multiple levels may be a 105 yard distance demarcation for the second level hitting platform directly above the bottom/first level hitting platform by 15 feet in height, so a guide or map can be positioned in front of hitting mats (131), or on the hitting stall safety walls (133). In some embodiment's, the driving range (100) may include a plurality of distance specifiers on hitting mats (131) or a range field surface (110) to display yardage numbers corresponding to the distance demarcation(s) (160). In further embodiment's, a distance specifier may display different yardage numbers depending on the hitting platform level it's viewed. As a non-limiting example, a distance specifier may display "100 yards" to golfers on the bottom/first level hitting platform (122), "105 yards" to golfers on the second level hitting platform (124) 15 feet (height) directly above the bottom/first level hitting platform, and "110 yards" to golfers on the third level hitting platform (126) 15 feet (height) directly above the second level hitting platform (124). Thus, golfers on the second level hitting platform (124) associate a red distance specifier as corresponding to a "105 yard" equivalent carry distance, and golfers on the third level hitting platform (126) associate a red distance specifier as corresponding to a "110 yard" equivalent carry distance. In some embodiment's, a camera system (170) may track and analyze a trajectory, and report the calculated data to golfers. As a non-limiting example, display screens at hitting stalls (132) may display a calculated equivalent carry distance, hit angle, ball-spin, ball-speed, and other information to golfers for each golf ball they hit.

In alternative embodiment's, the present invention may feature a driving range (100) which is not partially or totally subterranean. As a non-limiting example, a golf driving range (100) may include a plurality of hitting stalls (132) at or above the average adjacent grade, and a range-field-surface (110) which slopes, slants, or tilts upwardly above the average adjacent grade. In some embodiment's, a range field surface (110) may slope, slant, or tilt upwardly to create an uphill range field surface (118) at a slope such that golf balls are unable to remain stationary on the range-field-surface (110), but rather roll back down, and into a ball drain inlet (152), or ball station (156), or ball-bin, or other depository. In some embodiment's, a range field surface (110) may slope, slant, or tilt downward to create a downhill range field surface (119) at a slope such that golf balls are unable to remain stationary on the range field surface (110), but rather roll down, and into a ball drain inlet (152), or ball station (156), or ball-bin, or other depository. In some embodiment's, the back edge of the range field surface (114) may be constructed or built-up to 10, 20, 30, 40, 50, 60, 70, 80, 90, or 100 feet in height or more above the elevation of a bottom/first level hitting platform (122), or ball drain inlet (152), or canal, or depository. As a non-limiting example, a driving range (100) may have a ball drain inlet (152), canal, or depository on the range field surface (110) around the elevation of the average adjacent grade, a bottom/first level hitting platform (122) elevated about 5 feet above the average adjacent grade, and a back edge of the range field surface (114) that's elevated about 10 feet above the average adjacent grade, such that a downhill range field surface (119) slopes downwardly from the bottom/first level hitting platform (122) at a slope such that golf balls are unable to remain stationary on the range field surface (110), but rather roll down into the ball drain inlet (152), canal, or depository and an uphill range field surface (118) that slopes downwardly from the back edge of the range-field-surface (114) to the same ball drain inlet (152), canal, or depository at a slope such that golf balls are unable to remain stationary on the range field surface (110), but rather roll down into the ball drain inlet (152), canal, or depository. As another non-limiting example, a driving range (100) may have a ball drain inlet (152), canal, or depository on the range field surface (110) about 5-25 feet above the elevation of the average adjacent grade, a bottom/first level hitting platform (122) elevated about 10-30 feet above the average adjacent grade, and a back edge of the range field surface (114) that's elevated about 15-100 feet above the average adjacent grade, such that a downhill range field surface (119) slopes downwardly from the bottom/first level hitting platform (122) at a slope such that golf balls are unable to remain stationary on the range field surface (110), but rather roll down into the ball drain inlet (152), canal, or depository and an uphill range field surface (118) that slopes downwardly from the back edge of the range-field-surface (114) to the same ball drain inlet (152), canal, or depository at a slope such that golf balls are unable to remain stationary on the range field surface (110), but rather roll down into the ball drain inlet (152), or canal, or depository. As a non-limiting example, a driving range (100) may have a back edge of the range field surface (114) that's constructed or built-up to be elevated to 10-100 feet above the average adjacent grade and a bottom/first level hitting platform (122) elevated 5-30 feet above the average adjacent grade such that an uphill range field surface (118) slopes downwardly from the back edge of the range field surface (114) to the bottom/first level hitting platform at a slope such that golf balls are unable to remain stationary on the range field surface (110), but rather roll downward underneath the bottom/first level hitting platform (122) and into a ball drain inlet (152), or a ball station (156), or a canal, or a ball-bin, or other depository.

Figure 32:
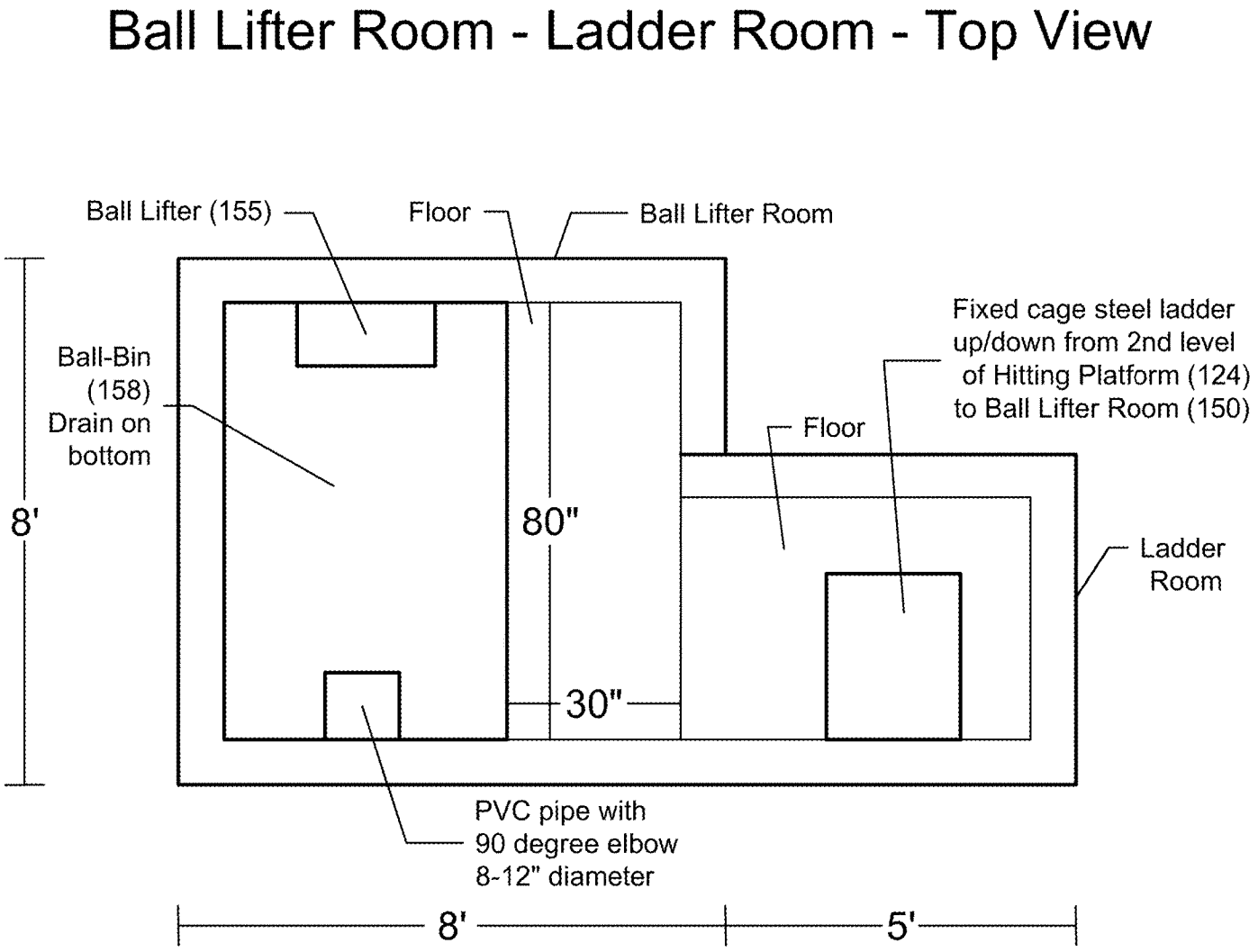
FIG. 32 shows an illustration of aspects of an embodiment of the present invention.
Figure 33:
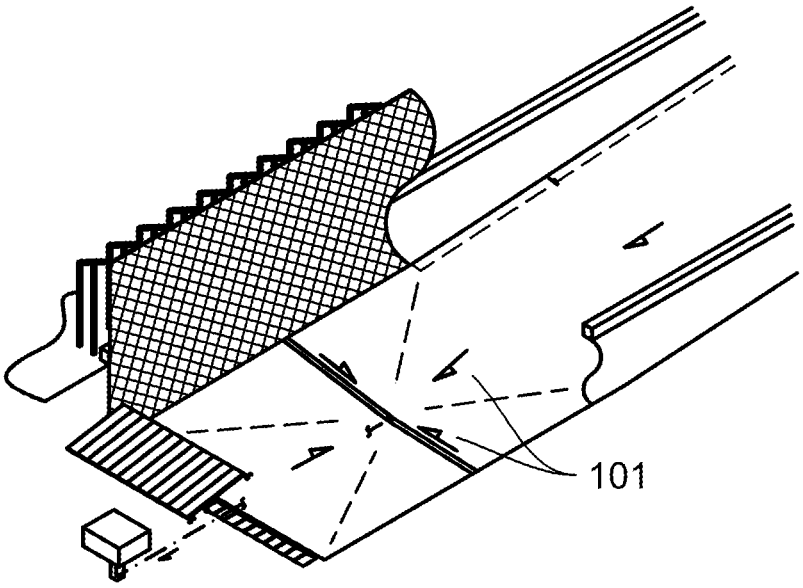
FIG. 33 shows an illustration of aspects of an embodiment of the present invention.
Figure 34:
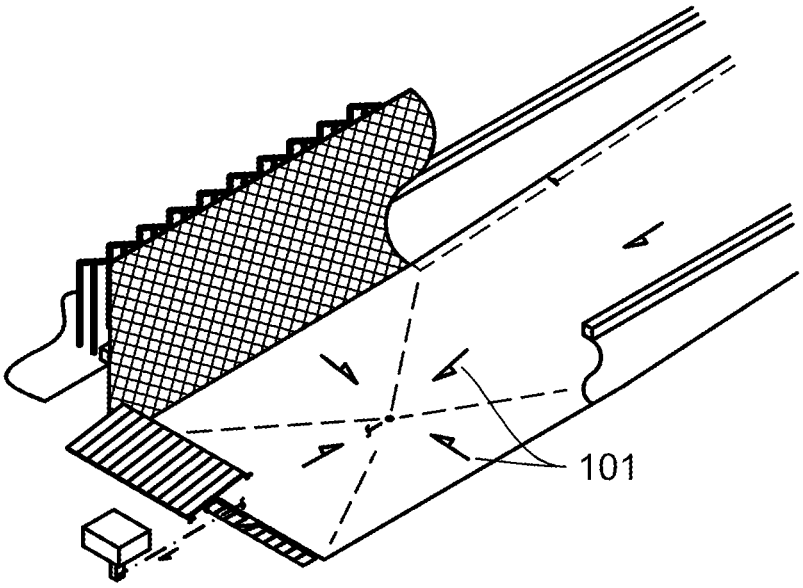
FIG. 34 shows an illustration of aspects of an embodiment of the present invention.
Figure 35:
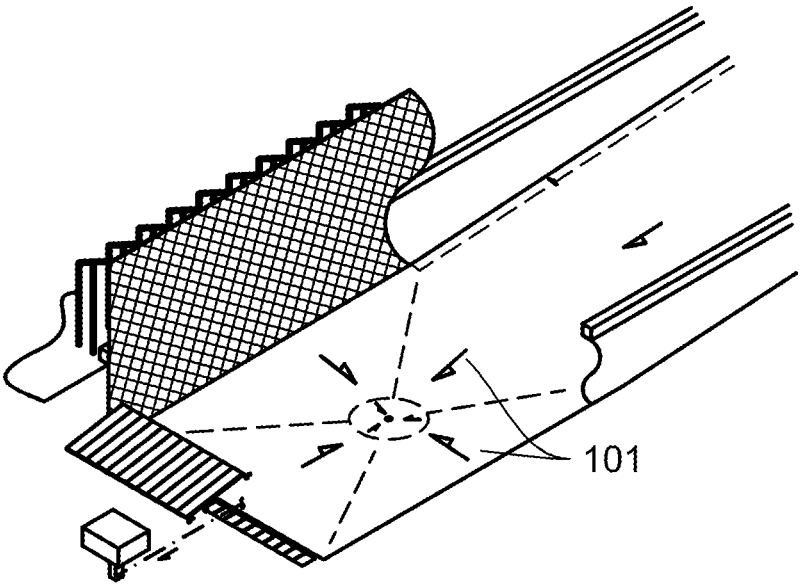
FIG. 35 shows an illustration of aspects of an embodiment of the present invention.
Figure 36:
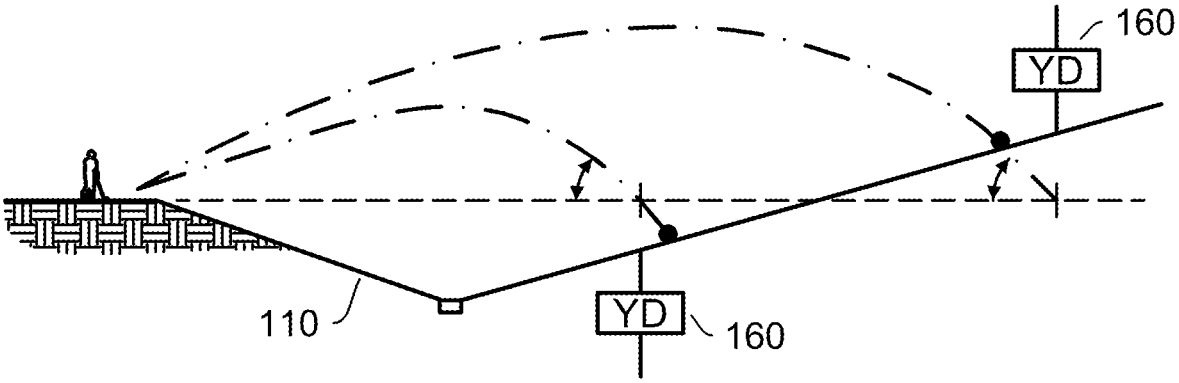
FIG. 36 shows an illustration of aspects of an embodiment of the present invention.
Figure 37:
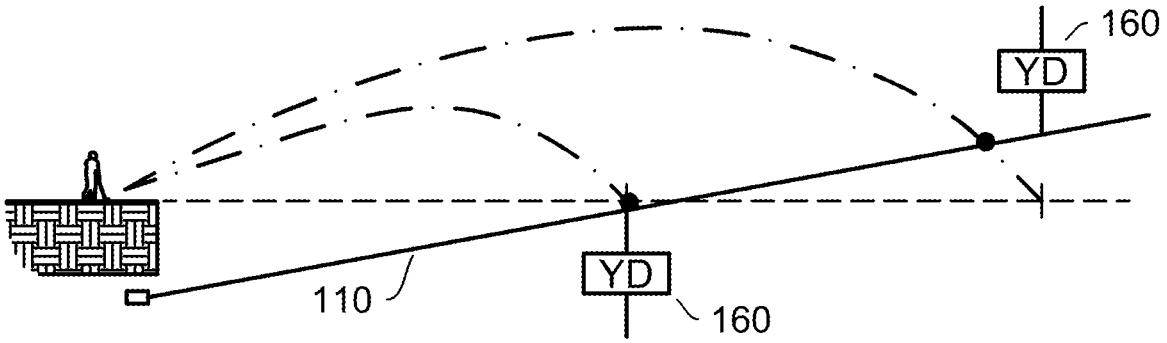
FIG. 37 shows an illustration of aspects of an embodiment of the present invention.

In FIG. 32, an isometric view of the improved driving range surface 110 designed for automatic ball return using gravity and a collection area underneath the bottom/first level hitting platform 122. The range field surface 110 is sloped about 3.8 deg toward the Bottom/First level hitting platforms 122. The side edge 116 of the range field surface surrounds the up range on three sides and is sloped downward toward the center of the driving range to prevent balls from remaining on the edges of the driving range. The side edge is sloped about 9.5 degrees from horizontal and the width of the side edge is about 6 feet wide. "A retaining wall 103 is needed when the driving range surface is more than 5 feet in elevation below or above the average adjacent grade."

To contain golf balls inside the range, a containment net 106 is used, preferably made from a nylon netting with a mesh size 1.25 inches or less. The containment net 106 is supported by vertical supports 104, and/or angled supports 105 on three sides of the range. The supports are about 20-100 feet in elevation above average adjacent grade.

In the case where there are multiple tiers of hitting platforms, the higher platforms are set back further from the first level hitting platform by using the same 1:1 calculation for positing the hitting stalls.

While various embodiments of the present invention have been described, the invention may be modified and adapted to various operational methods by those skilled in the art. Therefore, this invention is not limited to the description and figure shown herein, and includes all such embodiments, changes, and modifications that are encompassed by the scope of the claims.

The invention claimed is:

1. A golf driving range comprising an intentionally sloped range field surface and netting system surrounding said range field surface, wherein said range field surface is longitudinally sloped or slanted, wherein said range field surface is made of soft rubber-like material, and wherein said netting system comprises a plurality of vertical supports positioned at intervals around said range field surface, a plurality of angled supports extending at an angle from each of said vertical supports inwards towards said range field surface, and a containment net suspended from said angled supports, wherein said containment net is fixed to said range field surface.

2. The golf driving range of claim 1, wherein the range field surface is above-ground, subterranean, or a combination thereof, wherein the back edge of said range field surface is at a height below, at, or above the average adjacent grade.

3. The golf driving range of claim 1, the range field surface is intentionally sloped at a sufficiently steep angle to roll a golf ball down towards a ball drain inlet, canal or other ball depository location.

4. The golf driving range of claim 1, wherein the range field surface comprises a rubber, silicon, polymer, plastic, latex, elastomer, plastomer or other similar synthetic material.

5. The golf driving range of claim 1, wherein the netting system further comprises a cable running along the top edge of the containment net.

6. The golf driving range of claim 1, wherein the range field surface further comprises distance lines with corresponding distance numbers printed, painted, or otherwise demarcated directly on said range field surface, wherein said distance lines are accurately distanced from hitting stalls located on each tier or level of said hitting stalls.

7. The golf driving range of claim 1 comprising a plurality of bottom/first level hitting stalls disposed on a bottom/first level hitting platform, and a plurality of second level hitting stalls, disposed on a second level hitting platform, and a plurality of third level hitting stalls disposed on a third level hitting platform, wherein said second and third level are each setback at a certain distance from the level below.

8. The golf driving range of claim 1, wherein said hitting stalls are excavated or constructed below the average adjacent grade surrounding the golf driving range.

* * * * *